US012623157B2

(12) United States Patent
Spieldiener

(10) Patent No.: US 12,623,157 B2
(45) Date of Patent: May 12, 2026

(54) AMUSEMENT DEVICE

(71) Applicant: RAW TEX INTERNATIONAL ESTABLISHMENT, Schaan (LI)

(72) Inventor: Patrick Spieldiener, Schaan (LI)

(73) Assignee: RAW TEX INTERNATIONAL ESTABLISHMENT, Schaan (LI)

( * ) Notice: Subject to any disclaimer, the term of this patent is extended or adjusted under 35 U.S.C. 154(b) by 554 days.

(21) Appl. No.: 18/024,796

(22) PCT Filed: Sep. 2, 2021

(86) PCT No.: PCT/EP2021/074250

§ 371 (c)(1),
(2) Date: Mar. 6, 2023

(87) PCT Pub. No.: WO2022/049187

PCT Pub. Date: Mar. 10, 2022

(65) Prior Publication Data

US 2023/0390651 A1 Dec. 7, 2023

(30) Foreign Application Priority Data

Sep. 4, 2020 (DE) ..... 20 2020 105 107.5

(51) Int. Cl.
*A63G 7/00* (2006.01)

(52) U.S. Cl.
CPC ..... *A63G 7/00* (2013.01)

(58) Field of Classification Search
CPC ..... A63G 7/00; A63G 31/00; A63G 31/02
See application file for complete search history.

(56) References Cited

U.S. PATENT DOCUMENTS

| | | | | |
|---|---|---|---|---|
| 10,196,077 | B2 | 2/2019 | Sornik et al. | |
| 10,589,762 | B2 | 3/2020 | Rupp et al. | |
| 2016/0325189 | A1 | 11/2016 | Sornik et al. | |
| 2020/0215440 | A1 * | 7/2020 | Brister | A63G 21/14 |

FOREIGN PATENT DOCUMENTS

| | | | | |
|---|---|---|---|---|
| CN | 103505878 | A | 1/2014 | |
| DE | 4200567 | A1 | 7/1993 | |
| DE | 202017101109 | U1 | 3/2018 | |
| DE | 202017101787 | U1 | 4/2018 | |
| EP | 3099390 | A1 | 12/2016 | |
| EP | 3388120 | A1 | 10/2018 | |
| EP | 3099390 | B1 * | 12/2018 | A63G 21/04 |
| WO | 03009914 | A1 | 2/2003 | |
| WO | 2015113657 | A1 | 8/2015 | |

* cited by examiner

*Primary Examiner* — Robert J McCarry, Jr.
(74) *Attorney, Agent, or Firm* — McGlew and Tuttle, P.C.

(57) ABSTRACT

An amusement device (1) includes a transport apparatus (2) for passengers with a transport track (5) with transport track sections (13-19), a passenger transport unit (4) moving in a direction of travel (9), and a transport drive device (8). The passengers are accommodated on the respective transport unit (4) with a passenger orientation (10). The transport track (5) has a transport track course which is curved and twisted in regions with one or more downhill stretches (6), and at least one abrupt change of the transport track course by approximately 90° with a deflection unit (7) there which is configured as a stationary, greatly curved transport track section (8) and/or as a rotational device (27) with a movable transport track section (19). A variation unit (11) changes the passenger orientation (10) relative to the direction of travel (9) of the transport unit (4).

21 Claims, 16 Drawing Sheets

Fig. 7
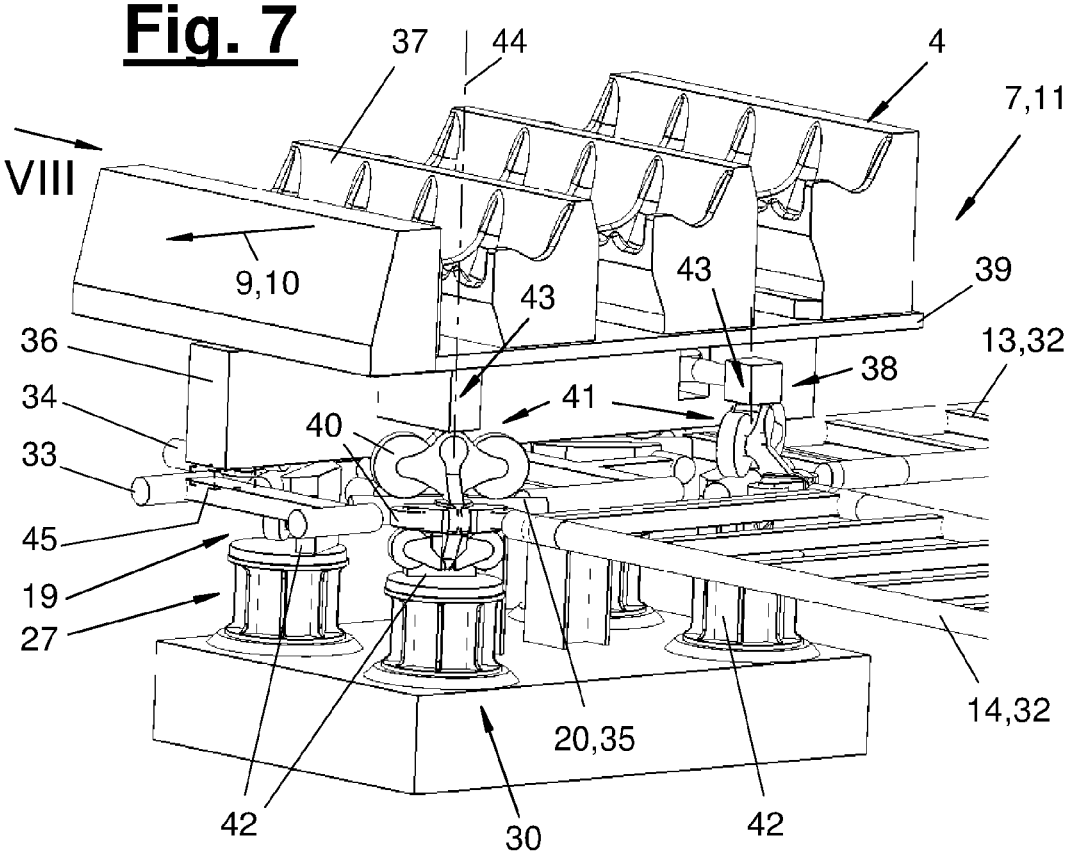
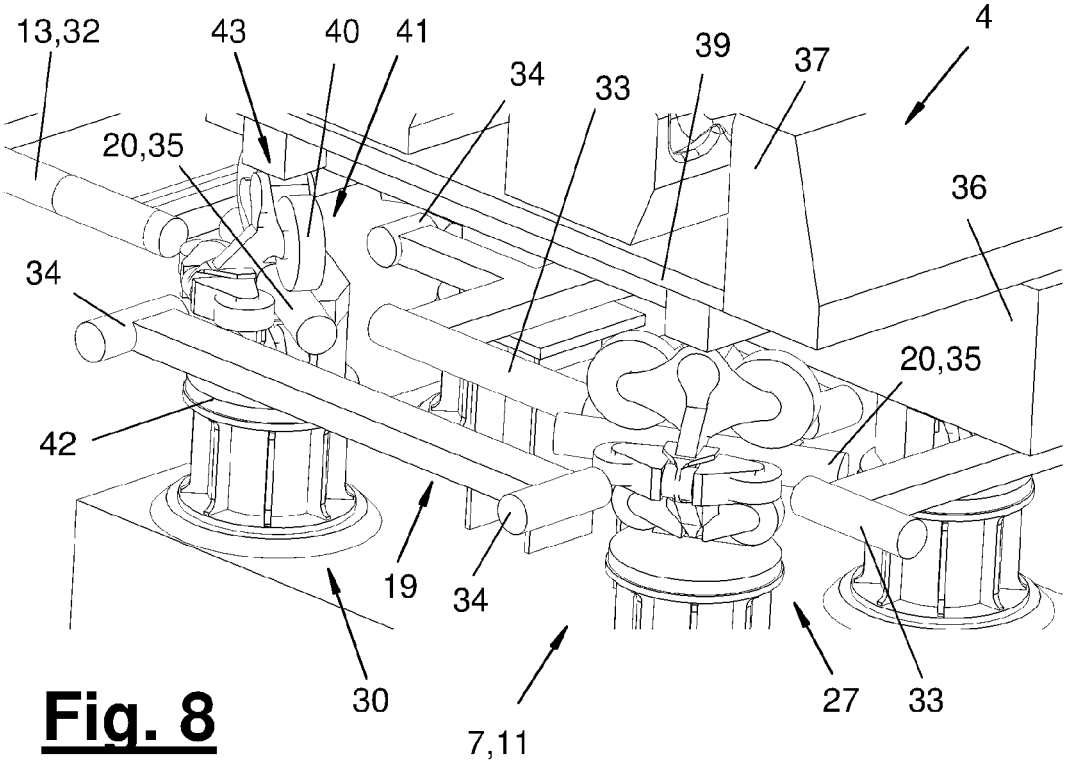
Fig. 8

AMUSEMENT DEVICE

CROSS REFERENCE TO RELATED APPLICATIONS

This application is a United States National Phase Application of International Application PCT/EP2021/074250, filed Sep. 2, 2021, and claims the benefit of priority under 35 U.S.C. § 119 of German Application 20 2020 105 107.5, filed Sep. 4, 2020, the entire contents of which are incorporated herein by reference.

TECHNICAL FIELD

The present invention pertains to an amusement facility with a transport device for passengers, which has a preferably ring-shaped, closed transport path with a plurality of transport path sections (transport track sections) and with one or more transport units for passengers that can be moved, especially propelled, along the transport path in a travel direction.

BACKGROUND

Amusement facilities or so-called amusement rides in the form of roller coasters have become well known from practice. These amusement facilities have a transport device for passengers, which comprises a ring-shaped, closed transport path with a plurality of transport units for passengers that can be moved in a travel direction at and along the transport path. The passengers are received at the respective transport unit with a passenger orientation, e.g., with the orientation and the viewing direction in the travel direction or in the longitudinal direction of the transport unit.

The transport device has a drive device for the transport unit or transport units. The transport path has a transport path course that is curved in at least some areas and is twisted in at least some areas and has one or more gradient sections. The transport units are accelerated with the drive device and can travel and accelerate on downward sloped gradient sections due to gravity and due to their own weight. They may also travel on upwards sloped gradient sections. The transport path may have a superelevation at the curved areas. The curved areas are configured as dynamic curves which are driven through rapidly and have a soft curvature or rounding with a large bending radius and with an arc angle of 150° and more. The path course may also have loopings, corkscrews and the like. The entertainment effect of such an amusement facility for the passengers is, above all, in the travel dynamics with high speeds of the transport units.

On the other hand, scenery units, in which a transport unit is pulled with a towing device along a transport path with a usually flat course at a controlled and low speed, are known from practice. Sceneries, e.g., projection screens or video screens, pirate scenes, dinosaur parks or the like with three-dimensional structures and figures, etc., are constructed along the transport path. The travel dynamics of the transport unit is minimal. The entertainment value is, above all, in the scenery.

SUMMARY

An object of the present invention is to show an amusement facility improved with regard to the entertainment value and experience value.

The present invention accomplishes this object with an amusement facility comprising a transport device for passengers, which has a preferably ring-shaped, closed transport path with a plurality of transport path sections (transport track sections) and with one or more transport units for passengers that can be moved, especially propelled. The transport unit is configured to move along the transport path in a travel direction. The passengers are received with a passenger orientation at the respective transport unit. The transport device comprises a drive device for the transport unit or for the transport units. The transport path has a transport path course, which is curved in at least some areas and is twisted in at least some areas and includes one or more gradient sections as well as and at least one abrupt change in the transport path course by about 90° with a deflection unit arranged there. The at least one deflection unit is configured as a stationary, highly curved transport path section and/or as a rotating device with a movable transport path section. The transport device has a variation unit for changing the orientation of the passengers relative to the travel direction of the transport unit.

The amusement facility has a configuration similar to a roller coaster with the above-mentioned transport device and a transport path course with slightly dynamic curvatures, torsions, rising and falling gradient sections and corresponding travel dynamics. The transport path may have a ring-shaped, closed path course. However, the transport path may also have cul-de-sacs for a reversing motion of the transport unit which cul-de-sacs project laterally from the ring shape. The single transport unit or plurality of transport units present travel along the transport path and are set into motion and accelerated as needed by means of one or more external, stationary and/or carried-along drive devices. As a result, they may also travel over rising gradient sections. The transport path may also be divided into a plurality of transport path sections.

The transport path has, in addition, at least one abrupt change in the transport path course. The transport path course has a change or deflection point here. A plurality of abrupt changes may be present in the transport path course. The angle of this change in the transport path course and of the transport device may be about 90°. At the charge or deflection point, the transport path course has a sharp curvature, which is distinguished by a torsion and superelevation in the transport path course from the other slight curvatures and dynamic curves formed hereby.

The transport path may extend in the connection area before and after the change or deflection point in the same, e.g., horizontal, plane. A torsion or superelevation is dispensable. The transport path may also have a gradient, especially a downward slope, directly following the change or deflection point. This gradient may possibly be reinforced in the further transport path course.

The travel dynamics of the arriving transport unit preferably changes at the change or deflection point. Braking is carried out in the travel direction before the change or deflection point to be able to follow the abrupt change in the transport path course. This braking and abrupt course change by about 90° increases the travel experience of the passengers. The deflection angle may be precisely 90°. It may also deviate from 90° slightly, e.g., by up to ±20°, while maintaining the abrupt change in the transport path course.

A deflection unit is located at the at least one change or deflection point. This deflection unit brings about said abrupt change in the transport path course. The deflection unit may be configured in different ways, e.g., as a stationary, highly curved transport path section, as a transfer device or as a rotating device. The at least one deflection unit may have a stop unit and/or a drive unit and/or a switch for the transport unit. The amusement facility may comprise a plurality of deflection units, which may possibly have different configurations.

The transport unit may travel around a tight curve on the highly curved transport path section. The deflection unit, which is configured as a transfer device or as a rotating device, may have a movable transport path section for the holder of a transport unit. This transport path section may be, e.g., rotatable and may be rotated by about 90° by a rotating device, wherein the charged transport unit continues after the rotation on an adjoining transport path section. The rotating device may make it possible to rotate the transport path section and the transport unit at the point, at which the transport unit is preferably located. The movable, especially displaceable, transport path section with the charged transport unit is transported in a transfer device by a transport shuttle along the adjoining stationary transport path section.

The at least one change or deflection point and the deflection unit may be located between transport path sections oriented at right angles to one another. The orientation at right angles may be rectangular or oblique and may form an angle of 90° or with the above-mentioned deviation. After the change or deflection point and the deflection unit, the transport unit arriving on a transport path section will continue on a different transport path section that is possibly sloped downward. The transport path may have an intersection between three or more adjoining transport path sections as well.

Furthermore, the transport device has a variation unit for changing the passenger orientation relative to the travel direction of the transport unit. A change in the passenger orientation during the travel likewise offers an increased riding and adventure appeal. The change in the passenger orientation may take place in a different manner and at different points of the transport path course.

The change in the passenger orientation may be coupled with the at least one abrupt change in the transport path course. The change may take place at this change point or deflection point and/or afterwards. The change in the passenger orientation may compensate for the abrupt change in the transport path course and in the transport direction. The passengers may be oriented by the change, e.g., at right angles to the further transport path course and to the travel direction. Additional effects can be achieved with this change in the passenger orientation, which may possibly also take place in a reversing manner.

The different embodiments of the deflection unit being claimed have each an independent inventive relevance and may also be used in other amusement facilities that do not have the features or do not have all the features of the principal claim. The independent inventive relevance also pertains to the embodiment of the transport path and of the variation unit for changing the passenger orientation, which embodiment is disclosed, especially claimed, in regard to the respective deflection unit.

The amusement facility may have a scenery feature (scenery) that is arranged at the transport path for entertaining the passengers. The scenery may be arranged in the area of the abrupt change in the transport path course or at the area of the deflection unit and/or following the abrupt change in the transport path course or at the deflection unit. The scenery may be arranged, e.g., next to the transport path. It may be configured as an imaging unit, e.g., as a flat or curved display screen with a display of stationary or moving images and possibly acoustic background music. A scenery may also be formed by three-dimensional structures and figures. In another embodiment, a scenery may enclose the transport path course in at least some areas, e.g., particularly in the form of a tunnel or channel. In addition, additional embodiment variants of the scenery are possible.

A scenery feature (scenery) is particularly appealing in conjunction with a change in the passenger orientation, e.g., at right angles to the transport path course and to the travel direction. The passengers may be oriented especially with a viewing direction towards a lateral scenery. The excitement of the scenery and a special riding experience overlap here due to the travel motion of the passengers at right angles to their passenger orientation.

The transport unit may also be accelerated on a transport path section during the continued driving following the at least one abrupt change in the transport path course or the change and deflection point. This may take place, e.g., by a gradient section directed downwards in the travel direction and/or by a drive device. The effect of the acceleration likewise increases stimulation.

The variation unit for changing the passenger orientation may be configured to rotate said passenger orientation about a vertical axis of the transport unit. The vertical axis may be oriented vertically to the horizontal principal plane of the transport unit. The vertical axis may extend along the upper body in case of a usually sitting or standing passenger posture. The passenger orientation may be rotated in a direction at right angles to the travel direction during said change in direction. This may be, e.g., an angle of precisely or approximately 90° to the travel direction or to the transport path course. The change in the orientation of the passenger may take place for the intended purpose of a scenery.

There are different possibilities for changing the passenger orientation. The passenger orientation can be rotated about said vertical axis at the transport unit. This may take place, e.g., in an opposite direction for the abrupt change in the transport path course and may be about −90° in a counter-rotation. The rotation takes place at the transport unit which otherwise retains its orientation relative to the transport path and to the travel direction. Passenger holders, especially seats, may be rotated individually or together during this rotation.

In another embodiment, said variation unit may rotate the transport unit about its said vertical axis and, as a result, change the passenger orientation relative to the travel direction. The function of the variation unit may in this case be integrated into the deflection unit.

In a deflection unit in the form of a stationary, highly curved transport path section between two transport path sections adjoining at each end, the transport unit remains on the transport path and makes a sharp turn. The radius of curvature may be, e.g., 7 m and less. The passenger orientation may be rotated about said vertical axis, e.g., at the transport unit.

An intersection between at least two transport path sections that are oriented at right angles to one another and end separately at the intersection may be located at the change or deflection point. Additional transport path sections with flush orientation may in the process also adjoin the intersection, wherein the transport unit may possibly, especially selectively, travel over the intersection even in the straight travel direction and without an abrupt change in the transport path course and in the travel direction. The deflection unit may advantageously be configured as a rotating device. The passenger orientation may be rotated at the transport unit or the transport unit may rotate about its vertical axis, possibly with integration of the function of the variation unit into the deflection unit.

The transport path may have additional path sections. The transport path sections directly adjoining in the direction of travel before and after the change and deflection point may have a straight orientation. This is favorable in conjunction with a scenery. The latter is also dispensable. The straight orientation may be present in at least some areas, especially in the connection area at the change and deflection point. Such a directly adjoining transport path section may have a gradient or extend horizontally.

Additional straight or slightly curved transport path sections having large radii of curvature and arc angles, which may also have a torsion about the longitudinal axis, may otherwise be present. In one embodiment a plurality of abrupt changes in the transport path course or change or deflection points may be arranged behind one another. Locally, they may form a U-shaped or Z-shaped transport path course. In this case, an arriving transport path area and an outgoing transport path area may be oriented at right angles to one another at a first change and deflection point. The outgoing transport path area is at the second change or deflection point at an arriving transport path area, wherein one or two outgoing transport path areas are oriented at right angles thereto. A connection of three or more transport path areas is also possible at the first change or deflection point or at other change or deflection points.

A transport path section may be configured as a dead-end section or as a cul-de-sac with an upright, preferably steep braking ramp at one end. The braking ramp may be used for the braking and the travel direction reversal of the transport unit. This stitch-like transport path section may adjoin a change or deflection point, especially an intersection of a plurality of transport path sections, at the other end. Another transport path section adjoining the dead-end section in a straight direction may have a rising gradient section, which forms, together with the braking ramp and with the areas of the transport path sections arranged deeper between them, a trough, which makes possible a reversing swing travel of the transport unit, possibly assisted by drive devices. Especially advantageous is a configuration of the deflection unit as a rotating device at the intersection. The dead-end section may travel through in a reversing manner with different as well as variable passenger orientations.

In a configuration of the deflection unit as a transfer device, the transport unit arriving from a transport path section on a movable transport path section may be transferred on a transport shuttle, which moves on the transport path section adjoining the change and deflection point. This shuttle motion may be reversing. An additional change and transfer point (deflection point) with an outgoing transport path section may be present at the end of the shuttle transport path section. The transport shuttle may move back and forth between the two change and deflection points.

The transport unit is transferred between the stationary transport path section and the movable transport path section of the transport shuttle. The movable transport path section may be oriented flush with the adjoining, stationary transport path section or transport path sections. It may have a stop unit for the arriving transport unit. It may also have a drive unit to convey away the transport unit onto the outgoing transport path section. During the transfer from the transport path section onto the transfer shuttle, the transport unit retains its orientation upon arrival and is moved by the transport shuttle with a transport device oriented at right angles thereto. The transfer device includes the function of the variation unit due to this transfer.

The stationary transport path section, which is driven on by the transport shuttle and is directed at right angles, may have a gradient sloped downwards in the travel direction at least at one end. The gradient may also be present at the other section end as well as in the middle area. The gradient does not have to be constant. Smaller rising gradient sections are possible in the path section course as well. Due to this gradient configuration, the transport shuttle may move downwards due to gravity with the charged transport unit in the travel direction. A shuttle drive may be present for the rearward or reversing motion in the empty state.

The transport shuttle may have a tilting device for the movable transport path section. The tilting axis may be oriented along the movable transport path section. The tilting device, which may have different configurations, may comprise a tilting unit to actuate the tilting motion. A configuration of the tilting unit as a sliding guide with a sliding path arranged at the stationary transport path section is especially advantageous. Consequently, the movable transport path section may be tilted for the transport unit as a function of the path or position of the transport shuttle at the stationary transport path section. This may be coupled, e.g., with a scenery. In another embodiment, the tilting device may be motor driven and be controlled in a different manner.

This arrangement of a tilting device at the transport shuttle has independent inventive relevance. It may also be used in other amusement facilities deviating from the principal claim, e.g., scenery units with lower travel dynamics.

There are a plurality of embodiment variants for a deflection unit configured as a rotating device. In this case, the deflection unit may be configured as a respective, controllably driven rotating device with a rotatable transport path section for the transport unit. The deflection unit may also have a stop unit and a drive unit for the transport unit.

The rotating device may be controllable such that the transport unit arriving on the one transport path section may continue after the rotation on another transport path section adjoining in the transverse direction. The control makes possible, on the other hand, that the transport unit arriving on the one transport path section may continue on another transport path section adjoining the intersection in a flush manner without rotation of its orientation. The rotating device may have the function of a turntable and may make possible a continuation of the transport unit in different directions after the change and deflection point.

In one embodiment, the rotating device may have a single rotating part for receiving the rotatable transport path section. The latter may in this case be rotated as a whole together with the received transport unit. The variation unit for changing the passenger orientation may be adapted to this rotation and may bring about, e.g., an opposite rotation of the passenger orientation. Consequently, the rotation of the transport unit can be compensated. The passengers can retain their orientation present at the arriving transport unit during the rotation of the transport unit and also during the continued travel of the transport unit on the adjoining transport path section which is oriented at right angles. As a result, the passengers notice only one stop of the travel motion during the ascension onto the rotatable transport path section and do not notice anything from the rotation of the rotating device due to the maintenance of their passenger orientation. The variation unit and the rotating device are coordinated with one another and carry out opposite rotations about a vertical axis of the transport unit. The variation unit in this case preferably rotates the passenger orientation at the transport unit.

In another embodiment variant, the rotating device has a plurality of rotating parts, which are each configured to receive a single, rotatable path element of the rotatable transport path section. In this case, the function of the variation unit may be integrated into the rotating device with a plurality of rotating parts.

The variation unit may have a different configuration for the embodiment of the above-mentioned changes in the passenger orientation. The transport unit has a passenger holder and a chassis with a drive for meshing with the transport path. In the different variants, the variation unit may always be arranged between the passenger holder and the drive.

In one variant, the variation unit has a controllably driven rotating unit. This rotating unit is used for the active rotation of the passenger holder relative to the drive with regard to said vertical axis. The rotating unit may be arranged between the passenger holder and the chassis. It makes possible the mentioned rotation of the passenger orientation vis-à-vis the transport unit. This embodiment is also advantageous for a configuration of the deflection unit as a highly curved and stationary transport path section. The rotating unit may have a suitable, e.g., electrical drive and an associated energy storage device. The, e.g., electrical and rechargeable energy storage device may possibly also supply a carried-along travel drive of the transport unit.

In another variant, the drive may have a plurality of separate drive groups, which are independently connected to the chassis. The variation unit may have for the drive groups a respective pivot bearing that is rotatable about said vertical axis in a free or controlled manner, e.g., with frictional resistance. This embodiment is advantageous for an interaction with the above-mentioned second variant of the rotating device with a plurality of rotating parts for the respective reception of a single rotatable path element.

During a rotation of the path elements, the drive group, which is meshing with the respective path element in a guided manner, can be rotated along thanks to its pivot bearing. During a previous and a subsequent travel motion of the drive due to its positive-locking meshing with a stationary path element, the pivot bearing can be held in the respective rotated position. In this variant, the drive is rotated relative to the chassis of the transport unit. The deflection takes place due to rotation of the drive. The transport unit may then travel along at right angles to its longitudinal extension on the next transport path section in the travel direction. In this embodiment, the function of the variation unit is integrated into the deflection unit.

The transport path has a guide device for the transport unit. This guide device may be configured in different ways. The transport unit may be guided standing or suspended at the transport path and at the guide device. The guide device is preferably configured as a guide device guiding multilaterally, wherein it guides the transport unit equipped with corresponding guide units upwards and downwards as well as laterally on both sides or to the left or to the right. A guide device guiding in a positive-locking manner, especially in the form of a rail guide, is favorable. This rail guide may have a plurality of parallel path elements, e.g., circular tubes, which are connected at right angles to one another. The guide unit at the transport unit or at the drive or at the drive groups may be configured as freely rotatable wheels. Guide devices acting multilaterally in the form of electromagnetic guides are possible, as an alternative.

The guide device may have a division into a plurality of guide sections which corresponds to the transport path and to its sections. The above-mentioned path elements may in this case be formed from guide elements, e.g., rail pieces. The guide section at a rotatable transport path section may have stationary guide elements oriented lengthwise and crosswise and rotatable guide elements, wherein the latter form each a single rotatable path element.

Additional advantageous embodiments of the present invention are described in the subclaims.

In one advantageous independent embodiment, provisions are made for the amusement facility to comprise a transport device for passengers, which has a preferably ring-shaped, closed transport path with a plurality of transport path sections and with one or more transport units for passengers that can be moved, especially propelled, along the transport path in a travel direction, wherein the passengers are received with a passenger orientation at the respective transport unit, wherein the transport device comprises a drive device for the transport unit or the transport units, wherein the transport path has a transport path course which is curved in at least some areas and is twisted in at least some areas, and one or more gradient sections, as well as at least one abrupt change in the transport path course by about 90° with a deflection unit being arranged there and being configured as a transfer device with a movable transport path section, and wherein the transport device has a variation unit for changing the passenger orientation relative to the travel direction of the transport unit.

The transfer device may have a transport shuttle with the movable transport path section and with a shuttle drive. The transport shuttle may be arranged in a reversibly movable manner on a transversely directed transport path section. The transfer device may at the same time form the variation unit for changing the passenger orientation.

The movable transport path section may be oriented with the one arriving transport path section in a flush manner.

The transversely directed transport path section may have at least one gradient which is sloped downwards in the travel direction of the transport shuttle at one end, preferably overall.

The transport shuttle may have a tilting device for the movable transport path section.

The tilting device may have a tilting unit for actuating the tilting motion.

The tilting unit may be configured as a sliding guide and may have a sliding path arranged at the transversely directed transport path section.

The independent embodiment may also comprise the additional claimed configurations of the amusement facility, especially the guide device, the scenery, the configurations of the transport path sections, especially the dead-end section with an upright braking ramp, etc. The independent embodiment of the amusement facility may, in addition, comprise one or more of the other variants of the deflection unit. The independent embodiment may also include a claimed variant of the variation unit for changing the passenger orientation.

The present invention will be shown as examples and schematically in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 and FIG. 8 are different detail views of the rotating device and of the variation unit from FIGS. 5 and 6 and of an embodiment of the transport unit;

DESCRIPTION OF PREFERRED EMBODIMENTS

Figure 1:
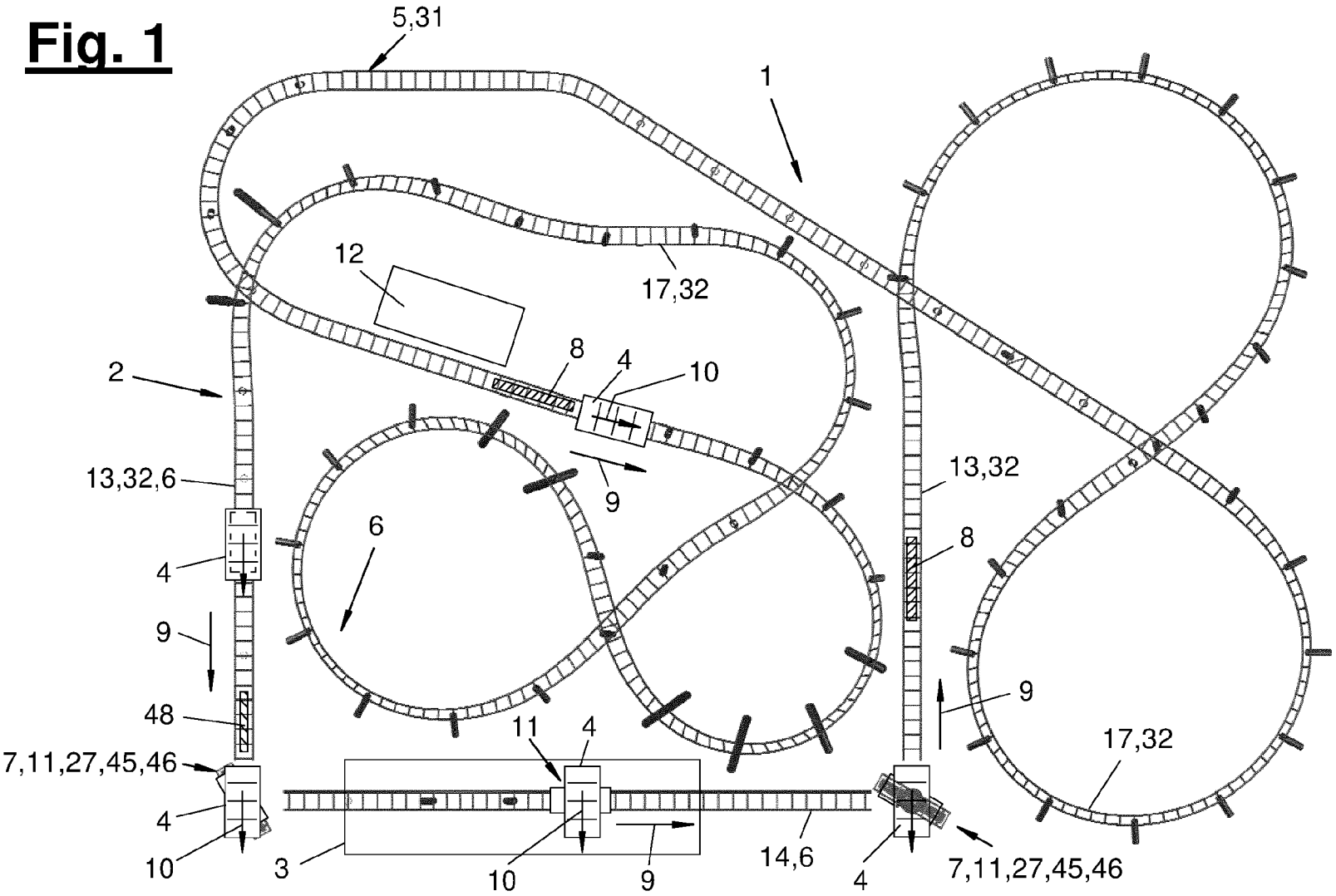
FIG. 1 is a schematic top view of an amusement facility with a transport device for passengers with an abrupt change in the transport path course and with a deflection unit as well as a variation unit located there.

Referring to the drawings, the present invention pertains to an amusement facility (1) with a transport device (2) for passengers. The amusement facility also pertains to a method for the transport of passengers at an amusement facility (1). The present invention pertains, in addition, to a plurality of independently inventive embodiments of a deflection unit (7) and of a tilting device (25) along with additional components.

FIG. 1 shows an amusement facility in a top view. The amusement facility (1) has a transport device (2) for passengers (not shown), which has a ring-shaped, closed transport path (5) with a plurality of transport units (4) for passengers that can be moved along the transport path (5) in a travel direction (9). The passengers are received at the transport units (4) with a passenger orientation (10). The passenger orientation (10) is determined, e.g., by a passenger holder (37), e.g., seats with backrests and retaining devices. In the starting state, e.g., the passenger orientation (10) may be oriented along the transport unit (4) and in the travel direction (9) thereof.

The transport path (5) has a preferably positive-locking guide device (31) for the transport unit (4), which is configured, e.g., as a rolling vehicle. The transport path (5) is divided into a plurality of transport path sections (transport track sections) (13-19), at which respective guide sections (32) are arranged.

The transport path (5) has a transport path course with one or more gradient sections (6) which is curved in at least some areas and is twisted in at least some areas. There are, e.g., slightly curved transport path sections (17) here which are configured as dynamic curves and at which the transport path (5) is twisted about its longitudinal axis and forms curve superelevations. The slightly curved transport path sections (17) have large radii of curvature of 10 m and more, wherein large arc angles of 150° and more may also be present. The transport unit (4) may travel at a high speed through the dynamic curves. The gradient sections (6) have a descending slope, at which gradient sections the transport unit (4) is moved due to its kinetic energy and also due to potential energy as well as due to its weight and with gravity. There are also rising gradient sections (6).

The transport path course is a roller coaster type transport path course. Different transport path sections are guided over each other in an intersecting manner. Loops, bends, loopings, corkscrews and similar dynamic areas may be present in the transport path course. The amusement facility (1) may have at the transport path (5) a train station (12) for the boarding and disembarking of the passengers at the transport unit (4).

The transport path (5) has at least one abrupt change in the transport path course by about 90°. A deflection unit (7) is arranged at this change or deflection point of the transport path course. The at least one deflection unit (7) may have different configurations, for which different variants will be shown and explained below.

Transport path areas (13, 14, 15) oriented at right angles to one another adjoin each the change or deflection point and the deflection unit. The transport unit (4) arriving, e.g., at a transport path area (13) in the travel direction (9) is deflected due to the abrupt change in the transport path course by about 90° to another continuing transport path area (14). The transport unit (4) can be deflected again by about 90° to another continuing transport path area (13, 15) at a further abrupt change of the transport path course at the end area of said transport path area (13, 15).

The transport path (5) from FIG. 1 has two abrupt changes in the transport path course with a respective deflection unit (7). The change and deflection points and the deflection unit (7) are spaced apart from one another, and a, e.g., straight transport path section (14) is arranged between them. This transport path section may have, e.g., a gradient descending in the travel direction (9). A respective, e.g., straight transport path section (13), which is oriented at right angles to the transport path section (14), adjoins the deflection unit (7). The two transport path sections (13, 14) may be oriented parallel to one another. The transport path course is U-shaped in this area.

In a variant, the transport path course may be Z-shaped or S-shaped in this area. The transport path (5) may also have more than two change and deflection points as well as deflection units (7). An even number of change and deflection points as well as deflection units (7) is favorable.

The transport device (2) further has a variation unit (11) for changing the passenger orientation (10) relative to the travel direction (9) of the transport unit (4). The change in the passenger orientation (10) may take place, e.g., at a change and deflection point as well as at a deflection unit (7). FIG. 1 shows on the transport path section (14) between the two deflection units (7) a transport unit (4) with a passenger orientation (10) which is changed and points at right angles to the transport direction (9).

A scenery feature (scenery) is arranged at the transport path (5), especially at the transport path section (14). This scenery is configured, e.g., as a tunnel, through which the transport unit (4) travels with the passengers oriented at right angles to the travel direction (9). Entertainment effects, especially light effects, image effects, sound effects or the like may act in the tunnel on the passengers during the travel of the transport unit. An identical or different scenery (3) may, as an alternative or in addition, be arranged at a change or deflection point. A scenery (3) may also be arranged at a different point in the transport path course.

The transport units (4) are moved at a slow speed and possibly stopped at the change or deflection point and at a deflection unit (7). The transport path (5) has in the travel direction (9) a braking unit (48) for the transport unit (4) before (in front of with respect to the direction of travel) an abrupt change in the transport path course. The braking unit (48) may be configured in any desired manner. The braking unit may, e.g., be formed from braking friction wheels, brake shoes, an eddy current brake or the like.

The transport device (2) further has one or more drive devices (8) for the transport unit (4). The drive devices (8) may be arranged in a stationary manner at the transport path (5). They may be configured in any desired, suitable manner, e.g., as driven friction wheels, catapult, towing drive, electrical linear drive or the like. The transport unit (4) has, e.g., no separate traveling mechanism.

The transport unit (4) may, in addition or as an alternative, have a separate, e.g., electrical traveling mechanism and an energy storage device in one variant. The, e.g., electrical energy storage device may be charged during the travel or when stationary, e.g., at a train station (12), e.g., by means of electromagnetic alternating fields, by means of sliding contacts or the like.

Figure 2:
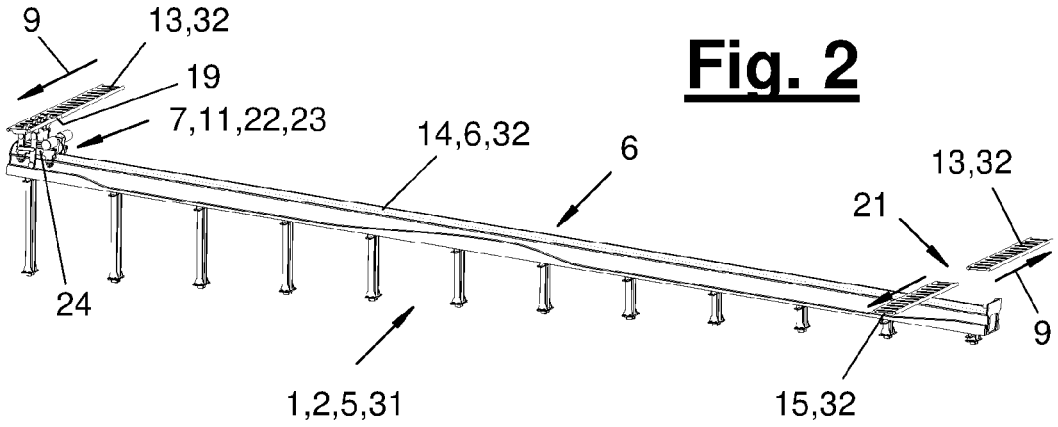
FIG. 2, FIG. 3 and FIG. 4 are schematic perspective views showing a variant of the transport device and of the deflection unit in a configuration as a transfer device and of the variation unit with a transport shuttle and a view of different travel positions of the transport shuttle.
Figure 3:
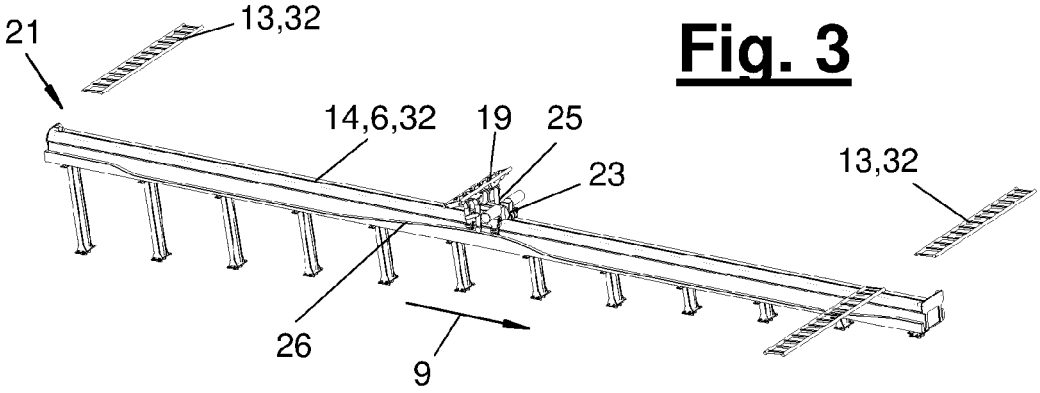
Figure 4:
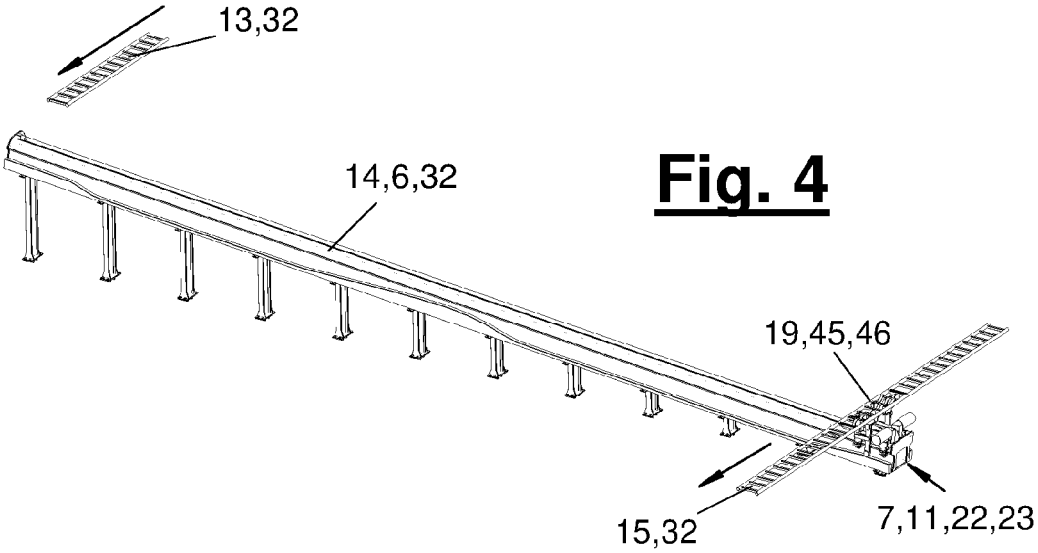
Figure 5:
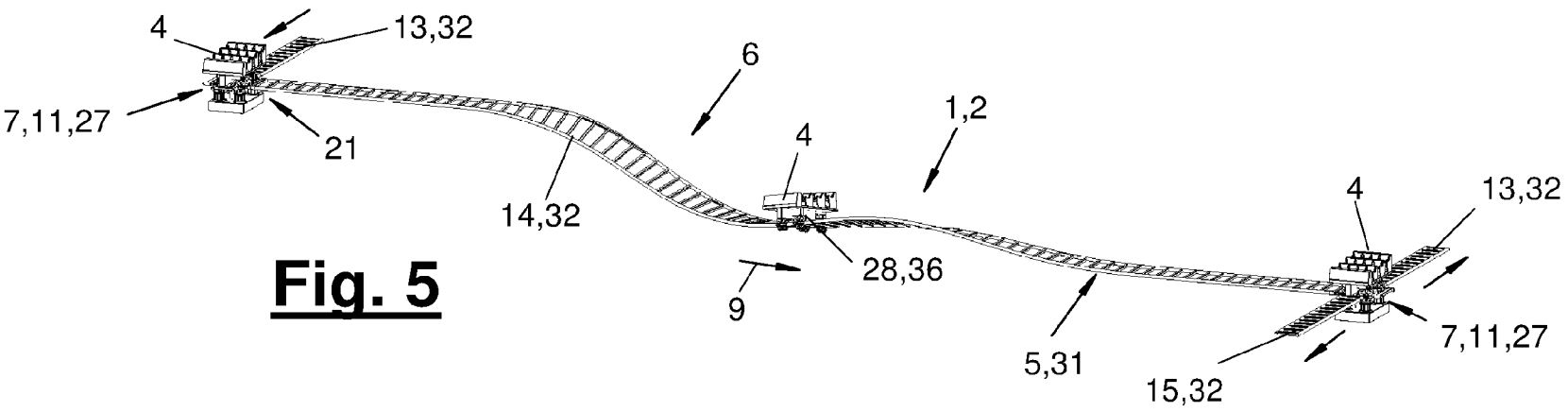
FIG. 5 and FIG. 6 are different schematic views showing a variant of the transport device and of the deflection unit and of the variation unit in a configuration as a rotating device.
Figure 6:
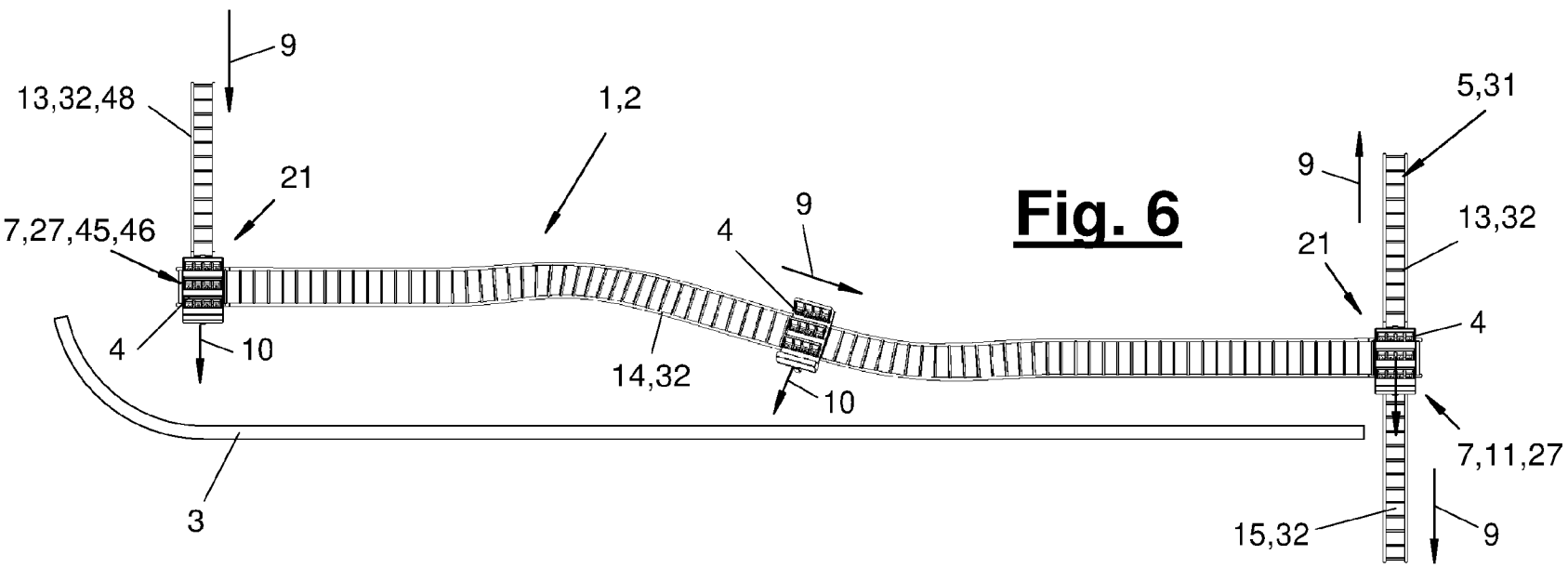

FIGS. 2 through 4 show an embodiment variant of the transport device (2) and of a deflection unit (7), which is configured here as a transfer device (22). The transfer device (22) has a movable and especially displaceable transport path section (19), which is arranged on a transport shuttle (23) and is transported by this transport shuttle along a stationary transport path section (14). The two stationary transport path sections (13, 14) end at the change and deflection point separately from one another. They are arranged at a right angle and at a different height to one another. A scenery (3) may be present and is not shown for the sake of clarity.

The transport shuttle (23) is mounted movably on the stationary transport path section (14) and may move along forwards and backwards with a reversing motion at this transport path section. The transport path section (14) has over its entire length a gradient sloped downwards in the travel direction (9). The transport shuttle (23) travels with the movable transport path section (19) and with the transport unit (4), which is charged there and is not shown, downwards in the travel direction (9) at the transport path section (14). The movable transport path section (19) and the charged transport unit (4) are in this case oriented at right angles to the stationary transport path section (14) and at right angles to the travel direction (9).

The movable transport path section (19) is oriented by the transport shuttle (23) flush with the stationary transport path section (13) at the change and deflection point. The transport unit (44) arriving here and possibly being braked beforehand travels on the movable transport path section (19) and is stopped here. The passenger orientation (10) first pointing in the travel direction (9) is maintained thereby. The passenger orientation (10) is oriented at right angles to the travel direction (9) at the stationary transport path section (4) during the travel of the transport shuttle (23). The variation unit (11) for changing the passenger orientation relative to the transport direction (9) is in this case integrated into the transfer device (22).

The transport shuttle (23) may by itself move away and move downwards from the change and deflection point due to its own weight. For the travel motion in the opposite direction, the transport shuttle (23) has a controllable shuttle drive (24). In addition, it has a braking unit for the fixing and positioning during the charging of the transport unit (4).

The transport shuttle (23) has a tilting device (25) for the movable transport path section (19). This movable transport path section (19) is mounted pivotably about a tilt axis directed at right angles to the longitudinal direction of the stationary transport path section (14). The tilting device (25) may be controllable. In the embodiment being shown, it has a tilting unit (26) for the actuation of the tilting motion. The tilting unit (26) is configured as a sliding guide and has a sliding path arranged at the stationary transport path unit (14), at which sliding path a support wheel runs along, which tilts the movable transport path section (19) corresponding to the sliding slope. In another embodiment, the tilting device (25) may have a motor driven and controlled tilting unit (26).

An additional change and deflection point of the transfer device (22) may be arranged at the end of the stationary transport path section (14). The movable transport path section (19) may be oriented here flush with another stationary transport path section (13) for the continuation of the transport unit (4).

The transfer device (22), and especially the transport shuttle (23) and/or the movable transport path section (19) may have a stop unit (45) for stopping and holding onto the ascending transport unit (4) and a drive unit (46) for releasing the charged transport unit (4) at a continuing transport path section (13).

In the embodiment with the transfer device (22), the abrupt change in the transport path course by 90° is brought about by transferring the transport unit (4) from the arriving transport path section (13) onto the movable transport path section (19) and due to its transversely directed further transport on the transport shuttle (23) in the 90° angle. The other abrupt change in the transport path course may be configured correspondingly.

The exemplary embodiment shows for this purpose a variant with a configuration as an intersection (21), at which three stationary transport path sections (13, 14, 15) adjoin the change and deflection point. The transport path sections (13, 15) are oriented at right angles to the transport path section (14) and are flush with one another. The transport unit (4) may selectively descend onto the one or other transport path section (13, 15). A movable transport path section (19) positioned at the intersection (21) also makes possible a straight passage of a transport unit from the one transport path section to the other transport path section (13, 15).

FIGS. 5 through 8 show another variant of a deflection unit (7), which is configured as a rotating device (27) here and which brings about the abrupt change in the transport path course by, e.g., 90°. An arriving stationary transport path section (13) and a discharging stationary transport path section (14) are arranged at a right angle to one another. For example, an additional change and deflection point with an abrupt change in the transport path course is arranged at the end of the discharging transport path section (14). This additional change and deflection point may be configured as an intersection (21) in the exemplary embodiment being shown.

The discharging transport path section (14) has a course which is curved and also twisted in some places as well as a downwards directed slope in this exemplary embodiment.

A scenery (3), which is configured, e.g., as an imaging unit, especially as a flat or curved display screen with a display of stationary or moving images and possibly acoustic background noise, may be arranged next to and along the transport path section (14) and/or at the change and deflection point.

The rotating device (27) has a movable transport path section (19) that is rotatable in this case. The movable transport path section (19) establishes a connection between the arriving and discharging stationary transport path sections (13, 14, 15). The variation unit (11) for changing the passenger orientation (10) is integrated into the deflection unit (7) and into the rotating device (27) in this embodiment.

As FIG. 7 and FIG. 8 illustrate with a viewing direction VIII from FIG. 7, the rotating device (27) has a controllable rotary drive (30). Four rotating parts (29) that are distributed in a rectangle, preferably in a square, and are arranged on a base, which are each configured for receiving a single rotatable path element (20) of the rotatable transport path section (19), are present here. The rotating parts (29) may have a shared rotary drive (30) with transmission gears or a respective separate rotary drive. The rotating parts (29) may be distributed in one variant in a rectangle with unequal side lengths, which may be useful, e.g., for unequal track widths of the adjacent transport path sections (13, 14, 15).

The guide section (32) of the movable transport path section (19) is formed here from stationary guide elements (33, 34) and rotatable guide elements (35). The rotatable guide elements (35) are likewise arranged in a rectangle, preferably in a square, and are each arranged at an intersection point between the stationary guide elements (33, 34). They form the rotatable path elements (20). The stationary guide elements (33) are oriented along the arriving stationary transport path section (13) and the other guide elements (34) are oriented at right angles thereto and along the discharging stationary transport path section (14).

In this embodiment of the rotating device (27), the guide device (31) is formed from parallel and, e.g., rail-like guide elements, which mesh with guide units (40), e.g., freely rotatable wheels, at the transport unit (4). The guide units (40) are in a positive-locking and multilateral guided meshing with the guide elements of the guide device (31). In another embodiment of the guide device (31), the configuration of the rotating device (27) and of the rotatable transport path section (19) may change correspondingly.

FIGS. 7 and 8 illustrate an embodiment of the transport unit (4) as an example. This transport unit has a chassis (36) with a drive (38) and with a passenger holder (37). The chassis (36) has, e.g., a beam-like configuration in some areas and may interact with the drive devices (8), with the braking units (48) as well as with stop and drive units (45, 46). The passenger holder (37) is formed from a plurality of rows of seats arranged behind one another on a platform (39) of the chassis (36).

The drive (38) in this embodiment is divided into a plurality of drive groups (41), which have each a plurality of guide units (40), e.g., wheels with multilaterally and differently directed arrangement at a guide element of the guide device (31). The drive groups (41) are arranged separately from one another at the chassis (36) and are thereby each mounted rotatably about a vertical axis (44) of the transport unit (4) at a lateral extension arm of the chassis (36). A pivot bearing (43), which can be rotated in a free or possibly controlled manner, is present here.

The vertical axis (44) is always at right angles to the principal plane of the transport unit (4) and of the platform (39). The mounting axes of the pivot bearings (43) and the likewise upright axes of rotation of the rotating parts (29) are flush with one another. They run together along said vertical axis (44). The vertical axis (44) may be arranged vertically in space. It may, as an alternative, be arranged obliquely with a predominantly vertical directional component.

The movable transport path section (19) of the rotating device (27) is provided with stop and drive units (45, 46). FIG. 7 shows a stop unit (44) schematically and in broken lines, which may also have a positioning function for the transport unit (4). It may be configured, e.g., as a controllable index, which has an adjustable cone at the transport path section (19) for meshing at a centering opening of the transport unit (4). The arriving transport unit (4) is stopped on the movable transport path section (19) positioned precisely with its drive groups (41) on the rotatable path elements (20) or the rotatable guide elements (35), wherein the axes of the pivot bearings (43) and of the rotating units (29) are preferably flush. Position tolerances may be compensated by elastic mounting elements.

The path elements (20) and the rotatable guide elements (35) are rotated by 90° by the respective rotating part (29) for the abrupt change in the transport path course. The rotatable guide elements (35) are then flush with the transversely directed stationary guide elements (34) and with the discharging transport path section (14). The drive groups (41) are likewise rotated by 90° and are oriented along the stationary guide elements (34). In this embodiment, the chassis (36) maintains its orientation, wherein the direction of action or the direction of travel of the drive (38) and of its drive groups (41) is rotated by 90°. The rotation of the drive group (41) induced by the rotating parts (29) forms the variation unit (11) in this embodiment and brings about a change in the orientation of the passengers (10) vis-à-vis the change in the travel direction (9) by 90°, which change accompanies the rotation of the drive. On the discharging stationary transport path section (14), the transport unit (4) is moved at right angles thereto while maintaining its arriving orientation from the chassis (36) and the passenger holder (37) as well as the passenger orientation (10).

FIGS. 9 through 13 show another variant of the transport device (2) and of a deflection unit (7), which is configured here as a rotating device (27), which has a different function and structural configuration compared with the above-described exemplary embodiment. In addition, another variation unit (11) is present for changing the passenger orientation (10) relative to the travel direction (9). The arrangement of the stationary arriving transport path sections (13) and of the discharging transport path sections (14, 15) as well as the formation of an intersection (21) are otherwise configured in a similar manner as in the previous exemplary embodiment.

The rotating device (27) is arranged at the change and deflection point of said abrupt change in the transport path course. The rotating device (27) has in this embodiment a single rotating part (28) with a controllable drive (30) as well as a rotatable transport path section (19), which is received on the rotating part (28). The rotating device (27) may rotate the rotatable path section (19) about a, e.g., upright, especially vertical, axis, which is oriented parallel to said vertical axis (44) of the variation unit (11). As an alternative, the axis of rotation of the rotating device (27) may also have a slope in one or more directions, and especially with a predominantly vertical directional component. The rotatable transport path section (19) may in each of its rotated positions be flush with the stationary transport path sections (13, 14, 15), which are oriented at right angles to one another and likewise in a flush manner.

Figure 12:
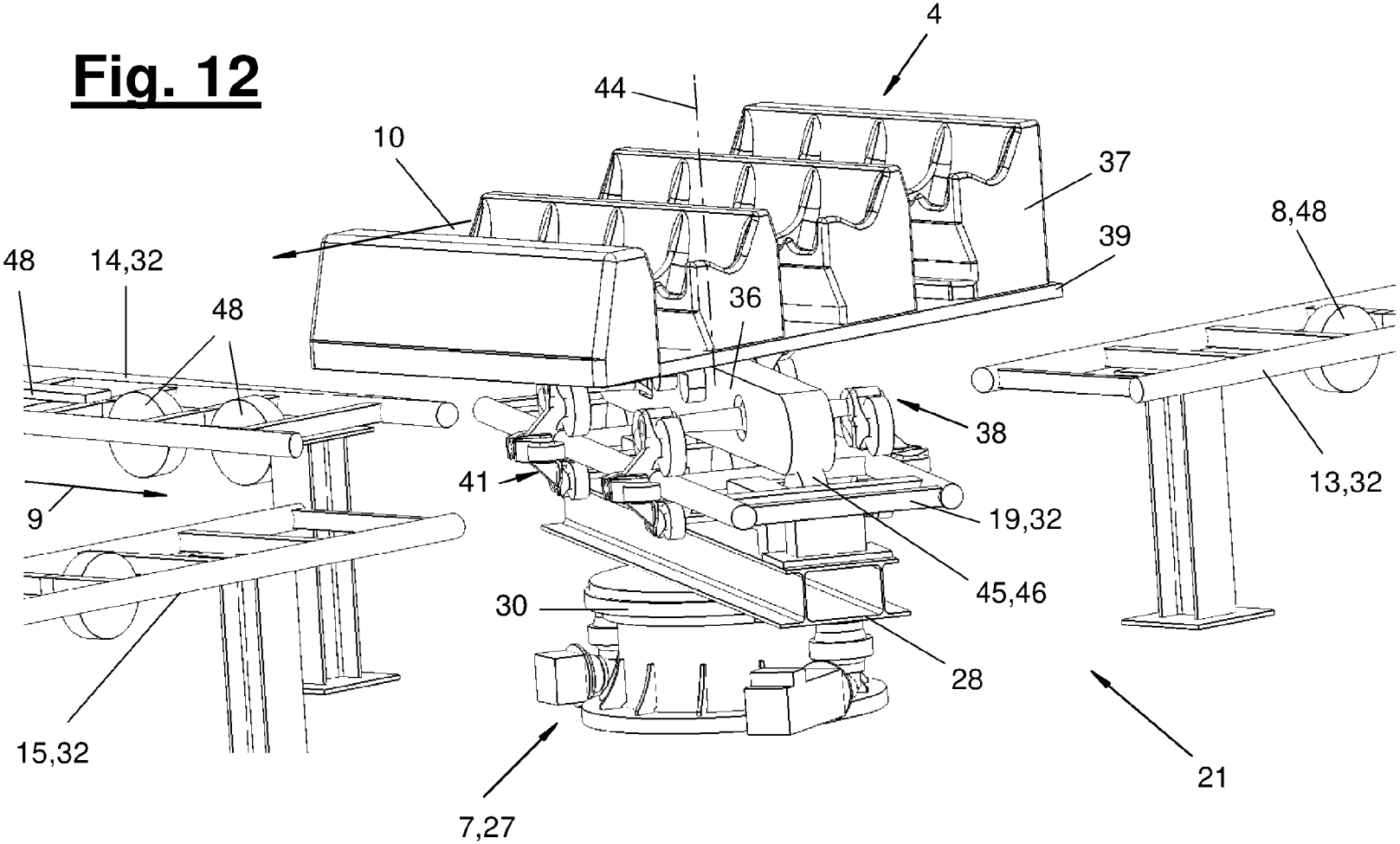
FIG. 12 and FIG. 13 are different schematic views showing the deflection unit and the variation unit from FIGS. 9-11 of an embodiment of the transport unit.
Figure 13:
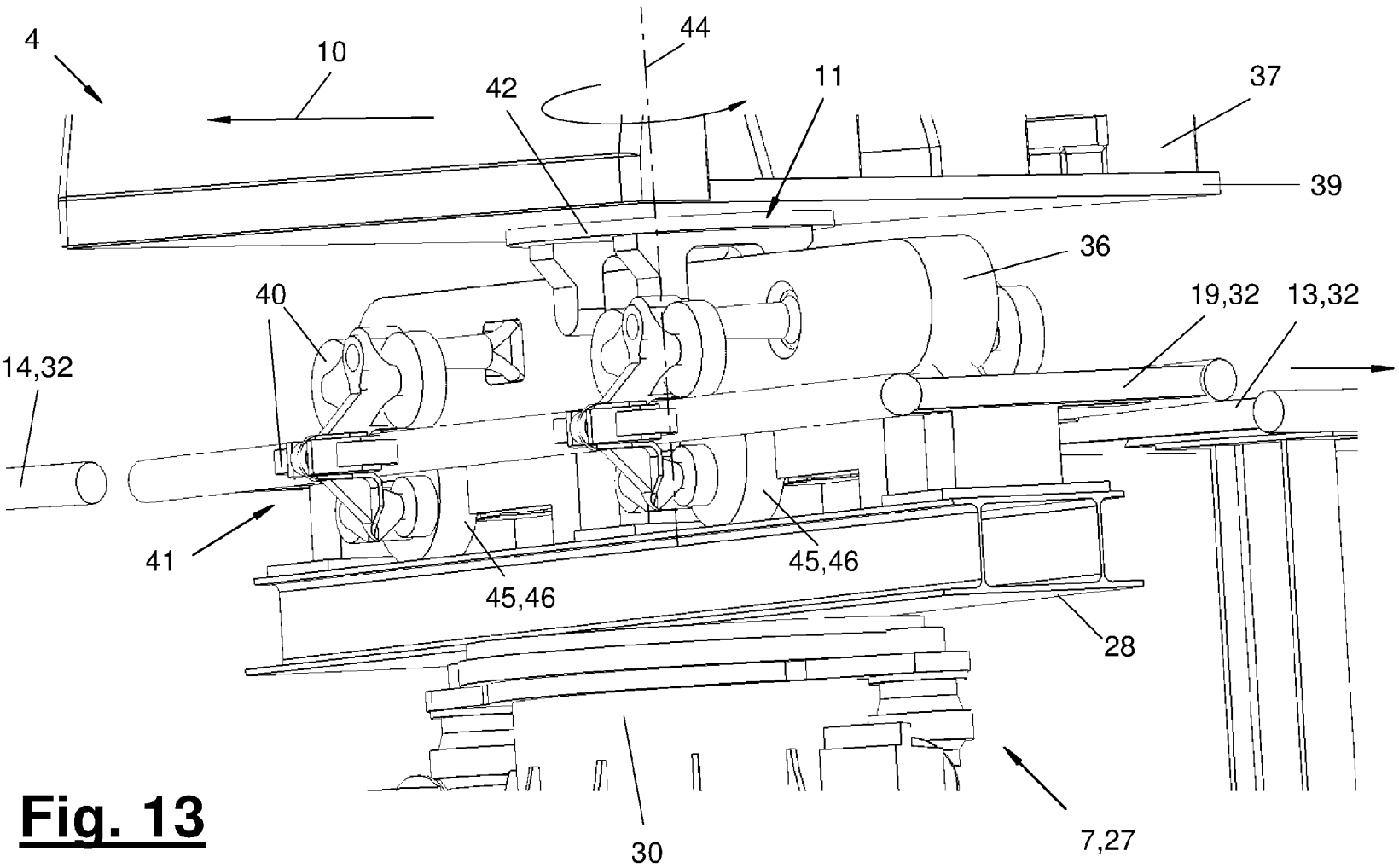

FIGS. 12 and 13 illustrate the embodiment of the rotating device (27) and of the transport unit (4) as well as of the variation unit (11). The transport unit (4) is configured in the above-described manner and has a chassis (36), a drive (38), a passenger holder (37) and a platform (39). The drive (38) may have a plurality of drive groups (41) with guide units (40), which are arranged in this embodiment rigidly or in a movable manner only for cornering in a limited manner at the chassis (36), for example, at extension arms located there.

The variation unit (11) in this embodiment rotates the passenger orientation (10) and the passenger holder (37) relative to the transport unit (4), especially relative to the chassis (36) and to the drive (38). The variation unit (11) has to this end a controllably driven rotating unit (42) between the platform (39) and the chassis (36), which rotating unit (42) has an upright axis of rotation and forms said vertical axis (44). The vertical axis (44) is preferably arranged centrally at the transport unit (4), especially at the chassis (36). The rotating unit (42) has an electric motor rotary drive and a connected electrical energy storage device. The energy storage device may be configured in the above-mentioned manner as a rechargeable storage battery.

The deflection unit (7), e.g., the rotating part (28) may have a stop unit and a drive unit (45, 46) for the transport unit (4), which are configured, e.g., as frictional wheels which can be driven in a controlled manner and which can interact with the chassis (36).

Figure 9:
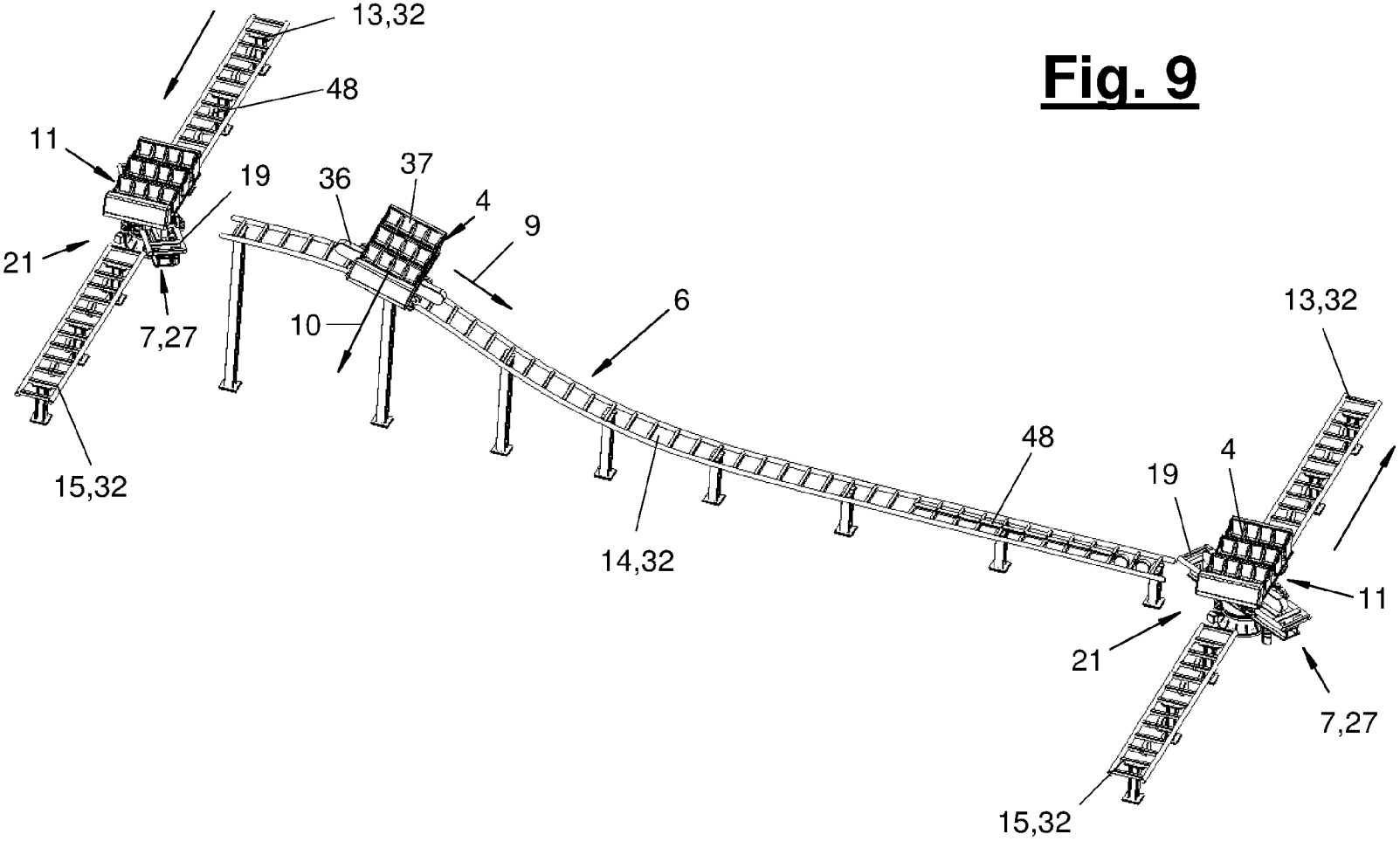
FIG. 9, FIG. 10 and FIG. 11 are different schematic views showing another variant of the transport device, of the deflection unit and of the variation unit.
Figure 10:
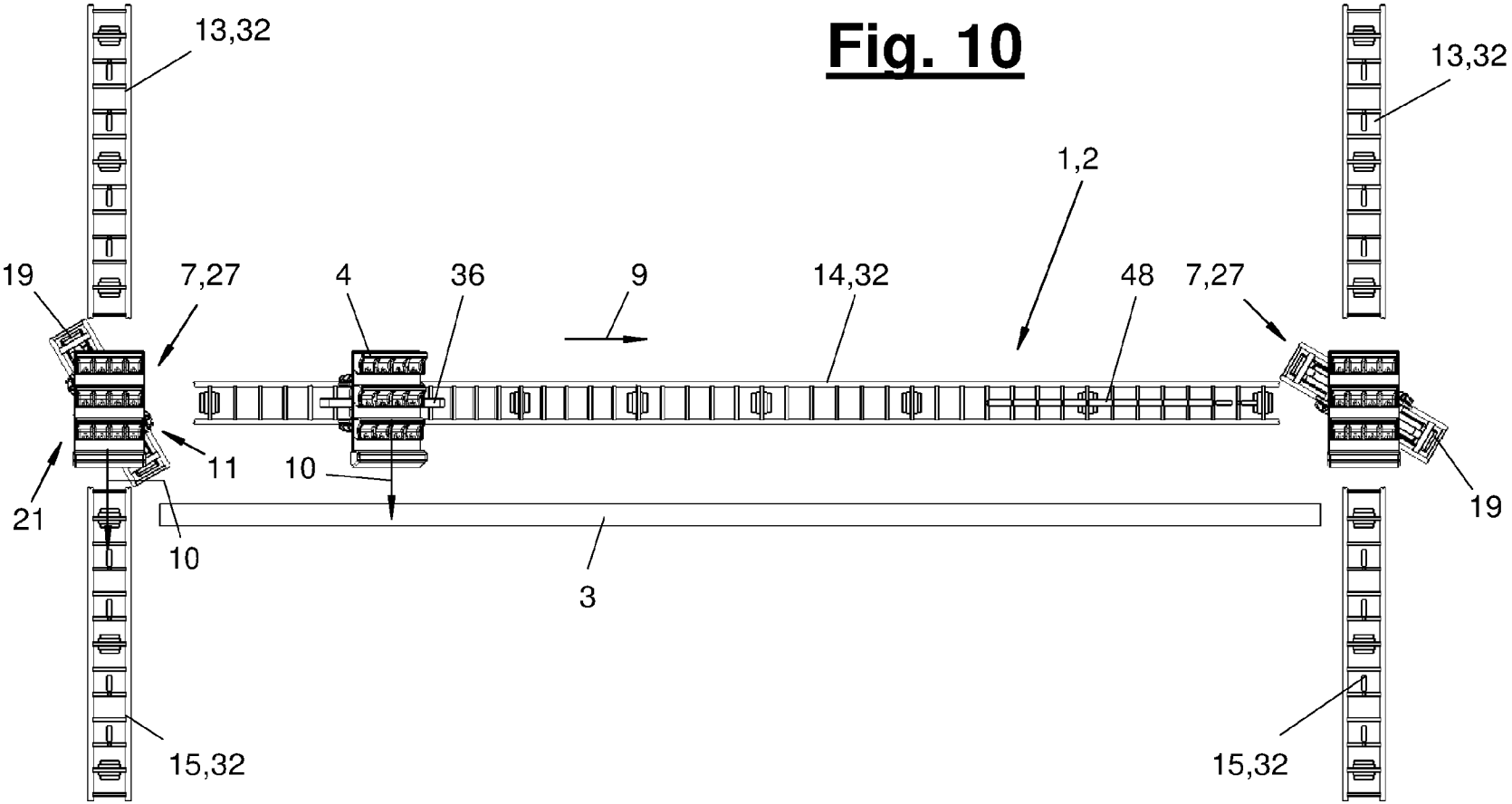
Figure 11:
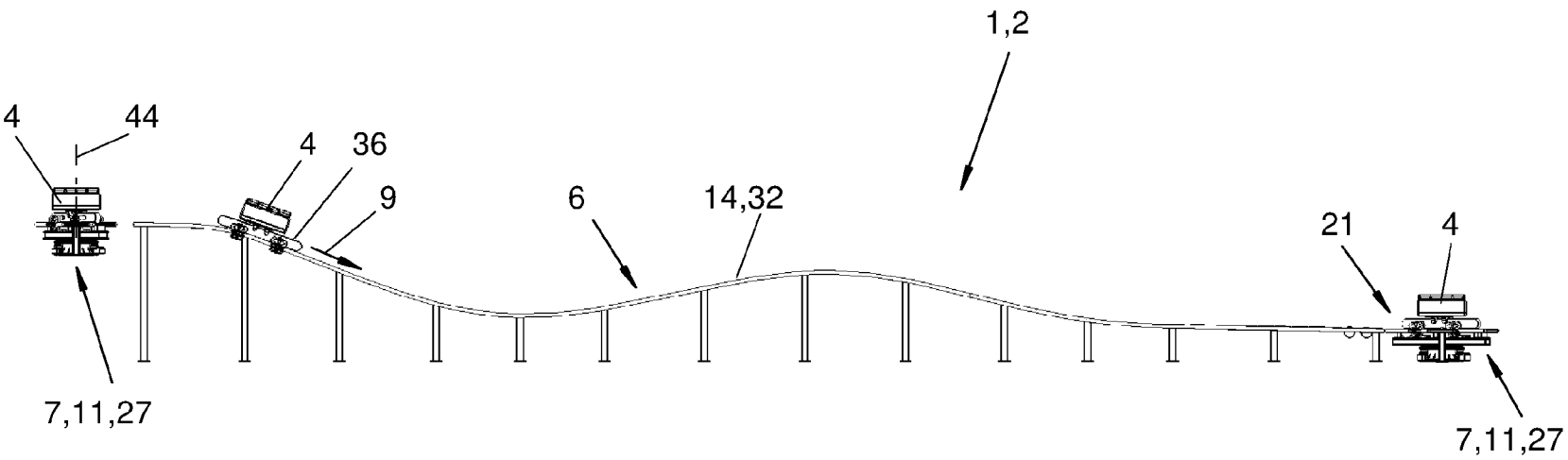

The transport unit arriving from the stationary transport path section (13) travels on the rotatable transport path section (19) oriented in a flush manner for this according to FIGS. 9 through 11 and is stopped as well as held here by a stop unit (45). The rotating unit (27) subsequently rotates the transport path section (19) with the charged transport unit (4) by 90° with flush orientation towards the outgoing stationary transport path section (14), which is configured as a gradient section (6). The axis of rotation of the rotating device (27) and the vertical axis (44) of the variation unit (11) may coincide. The variation unit (11) may carry out an opposite and equal rotation during rotation of the rotating device (27). The result of this is that the passenger orientation (10) of the arriving transport unit (4) remains unchanged, and the chassis (36) and the drive (38) are rotated by 90° under the passenger holder (37). In case of a precise mutual coordination of the opposite rotations, the passengers on the transport unit (4) notice only the travel stop at the deflection unit (7), but not the rotation of the chassis (36) and of the drive (38).

The transport unit (4) on the discharging stationary transport path section (44) is then released, and the passenger orientation (10) and the travel direction (9) are oriented at right angles to one another and the passengers are transported at right angles to their sitting and viewing direction. A scenery (3) of the above-described type may likewise be arranged at the stationary transport section (14). In addition, the exemplary embodiment shows the possibility of the transport path section (14) having a more demanding configuration in terms of travel dynamics and of installing differently sloped gradient sections (6) as well as possibly torsions. A rotation of the rotating device (27) and a possibly opposite rotation of the variation unit (11) may, in turn, be carried out at the second change and deflection point or intersection (21). As an alternative, a rotation of the variation unit (11) about the vertical axis (44) may only be carried out following the rotation of the rotating device (27).

Figure 14:
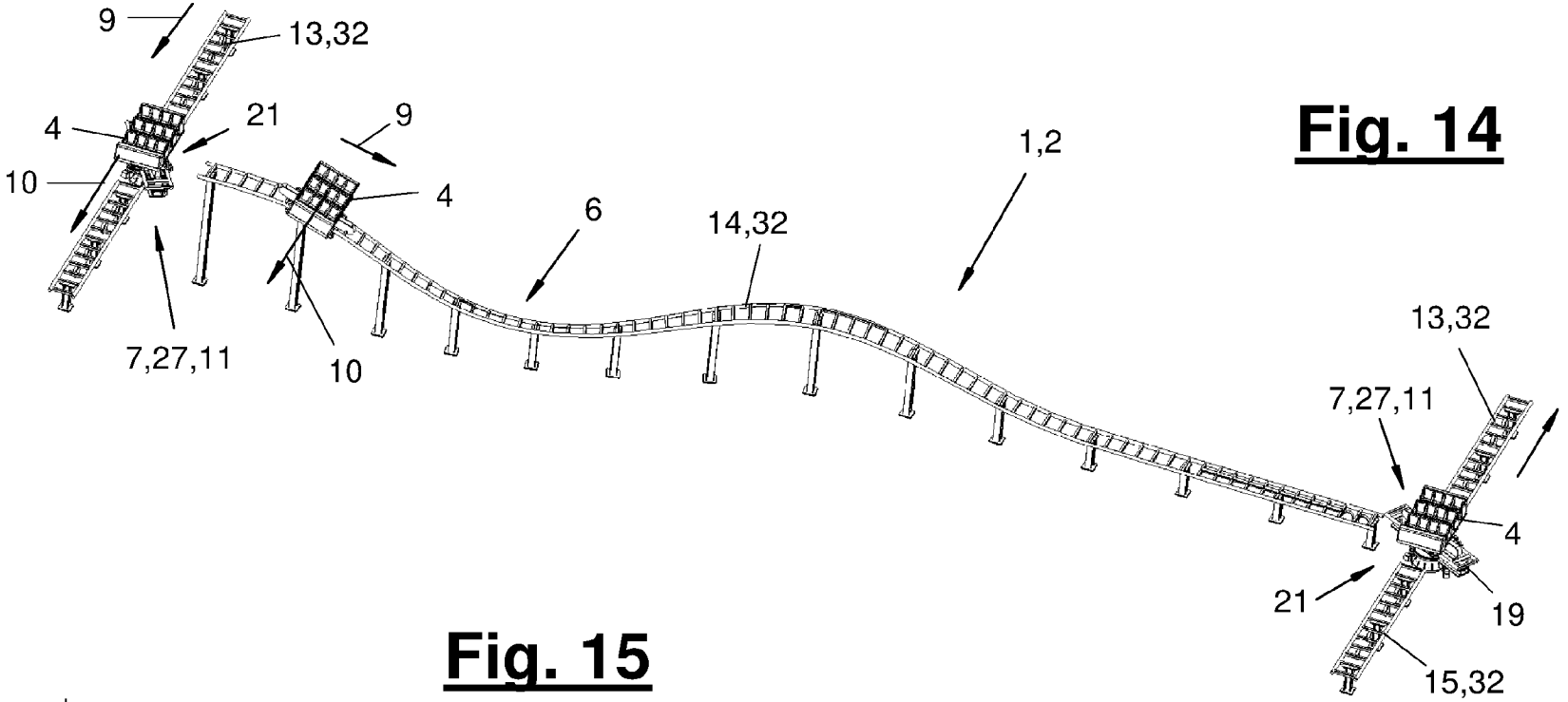
FIG. 14, FIG. 15 and FIG. 16 are different schematic views showing other variants of the transport device with a deflection unit configured as a rotating device.
Figure 15:
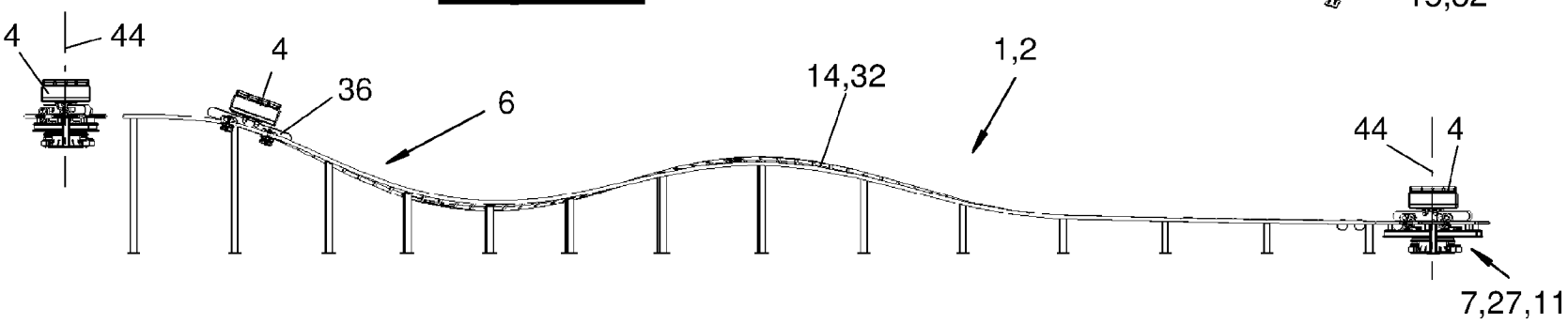
Figure 16:
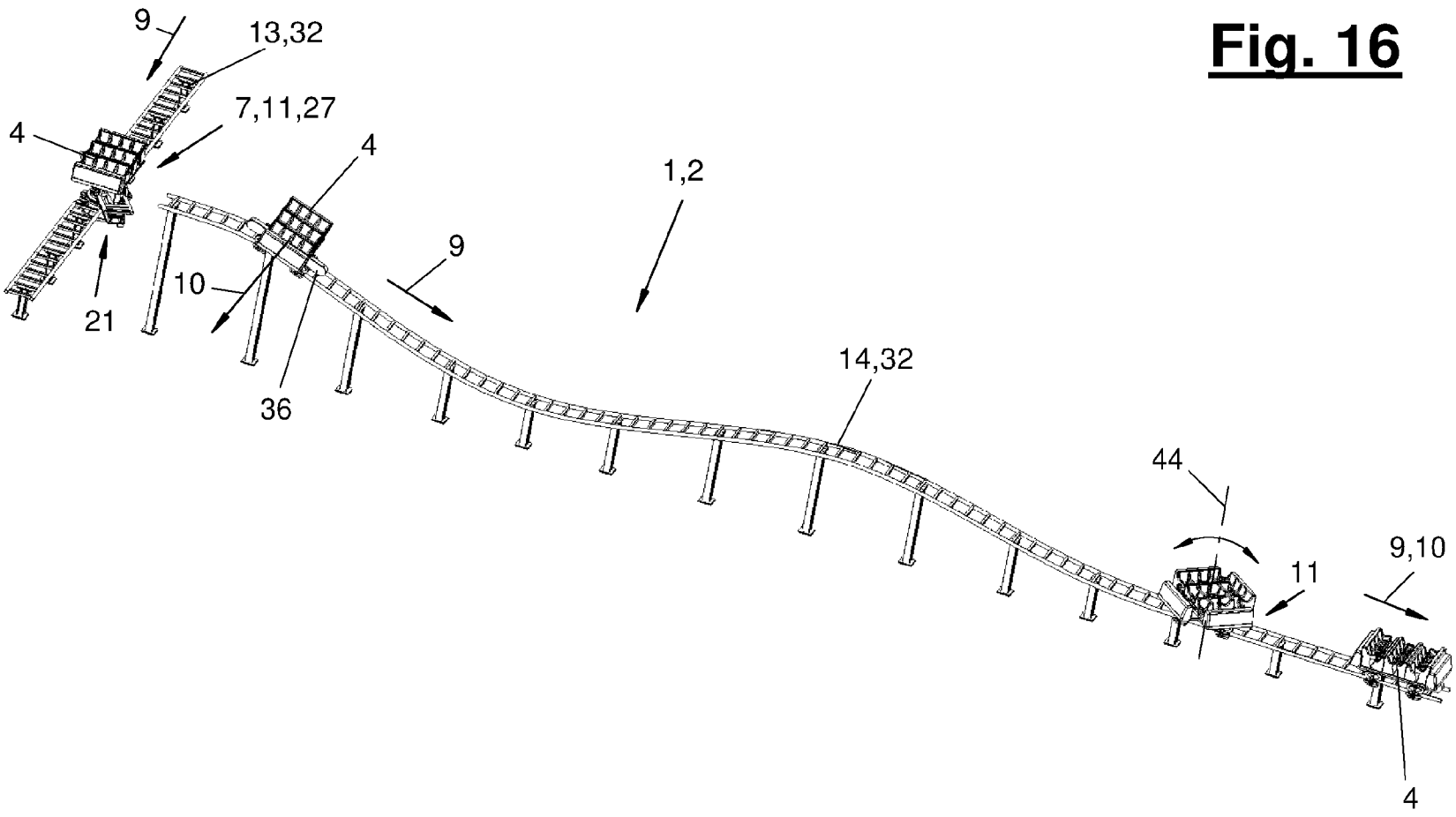

FIGS. 14 through 16 show other variants in the configuration of the transport device (2), wherein the same rotating device (27) described above with the rotatable transport path section (19) rotated in its entirety is provided. FIGS. 14 and 15 show a different configuration of the discharging and downward sloped stationary transport path section (14) and of the gradient sections (6) as well as of the torsions. A scenery (3) is absent in this variant.

The second abrupt change in the transport path course and the deflection unit (7) located there are omitted in the embodiment from FIG. 16. The transport unit (4) continues on the stationary discharging transport path section (14). The variation unit (11) may now eliminate the orientation at right angles of the passenger orientation (11) formed beforehand and of the travel direction (9) and orient the passenger orientation (10) in the travel direction (9) or in the opposite direction for reversing.

Figure 17:
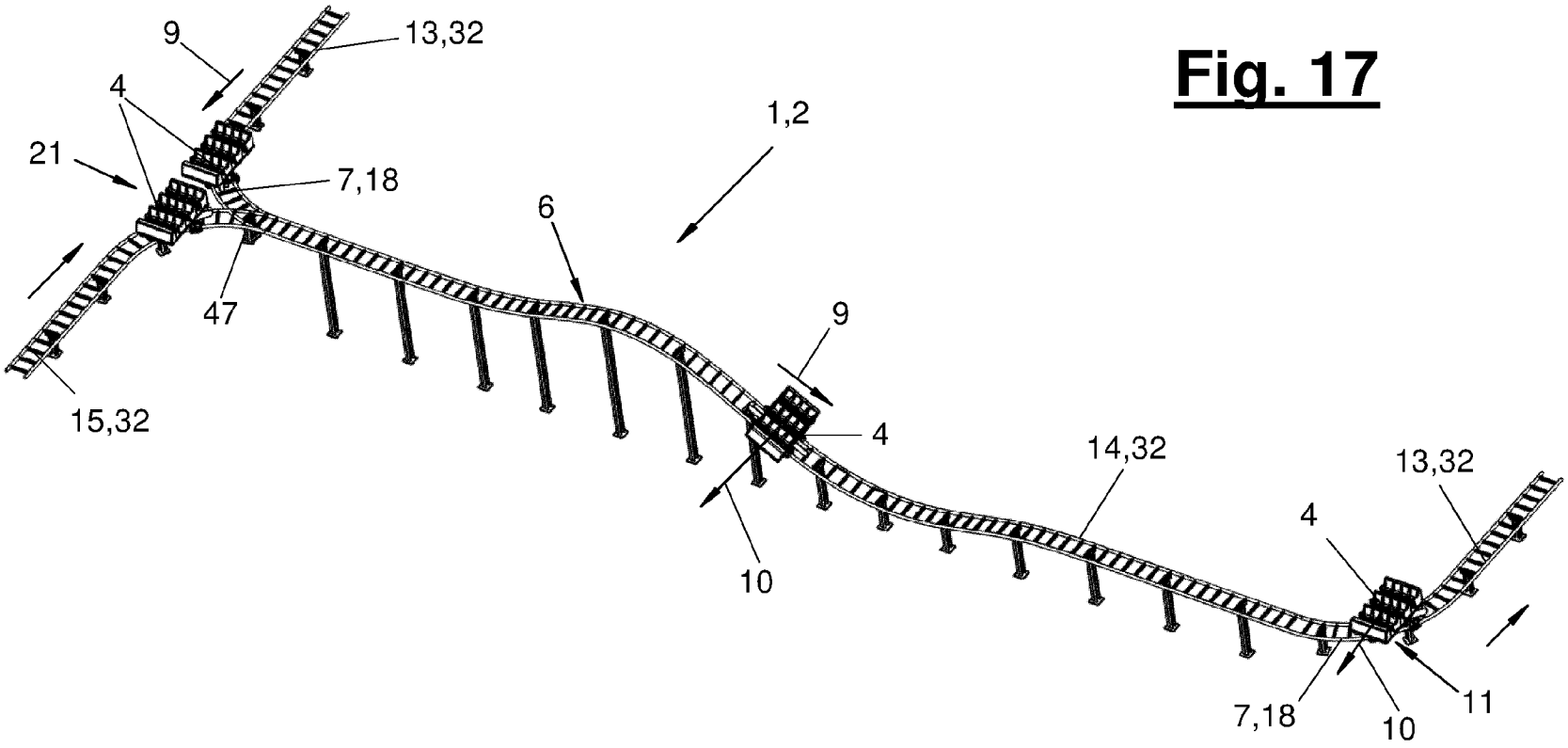
FIG. 17 and FIG. 18 are different schematic views showing other variants of the transport device with a configuration of the deflection unit as a highly curved transport path section (transport track section)
Figure 18:
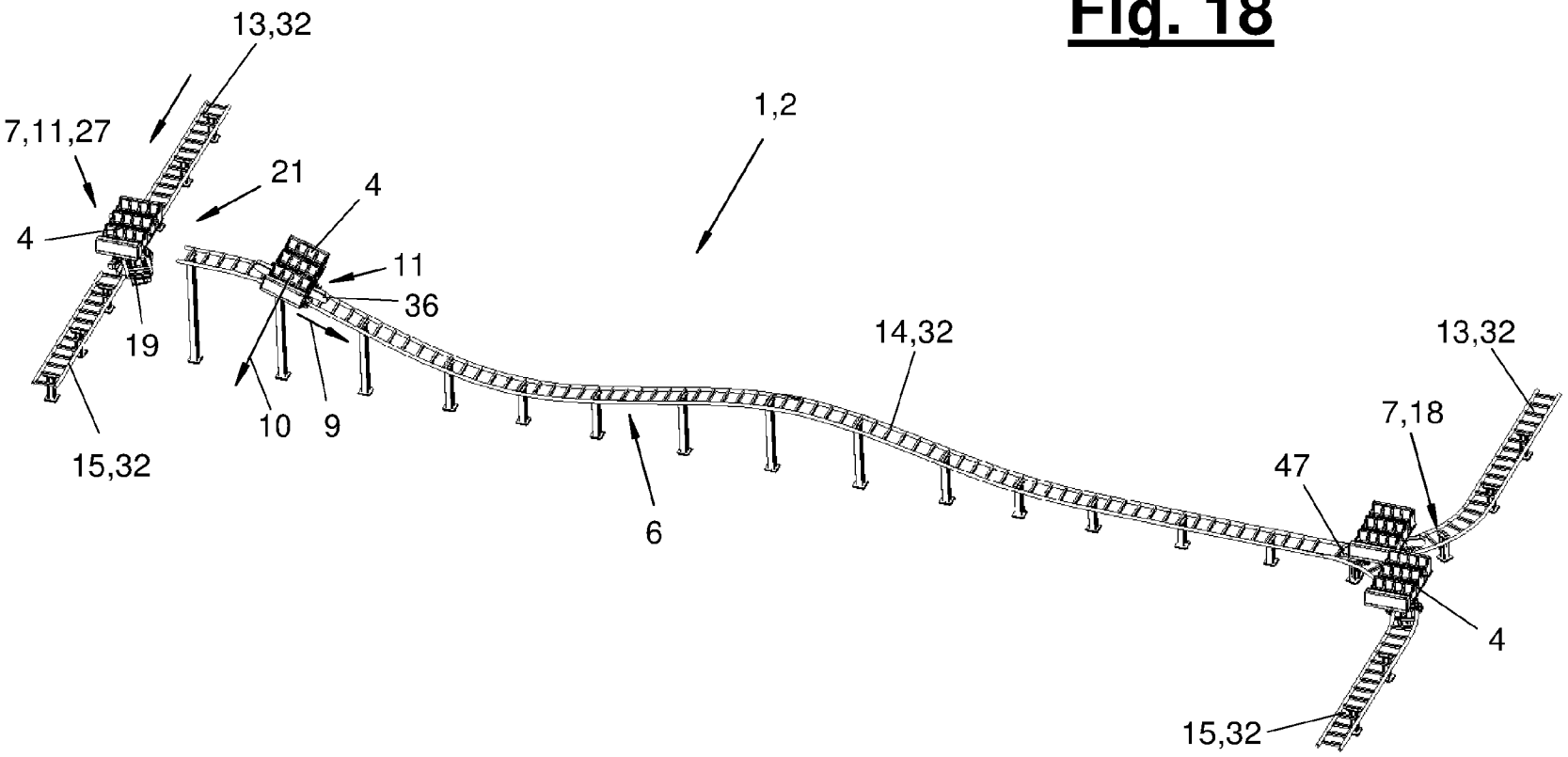

FIGS. 17 and 18 illustrate another variant of the deflection device (7), which is formed here from a stationary and highly curved transport path section (18) that adjoins the arriving stationary transport path section and the discharging stationary transport path section (13, 14) at both ends in a flush and preferably fixed manner. The arriving vehicle turns a sharp curve on the curved transport path section (18) during the abrupt change in the transport path course. The formation of one or more intersections is likewise possible in this embodiment of the deflection unit. Herein, two highly curved transport path sections (18) with a switch (47) may be arranged at a change and deflection point. The variation unit (11) for changing the passenger orientation (11) relative to the drive direction (9) may have the above-described configuration with the rotating unit (42).

FIG. 18 illustrates, in addition, that different deflection units (7) can be used at the transport path (5) in case of the transport device (2).

Figure 19:
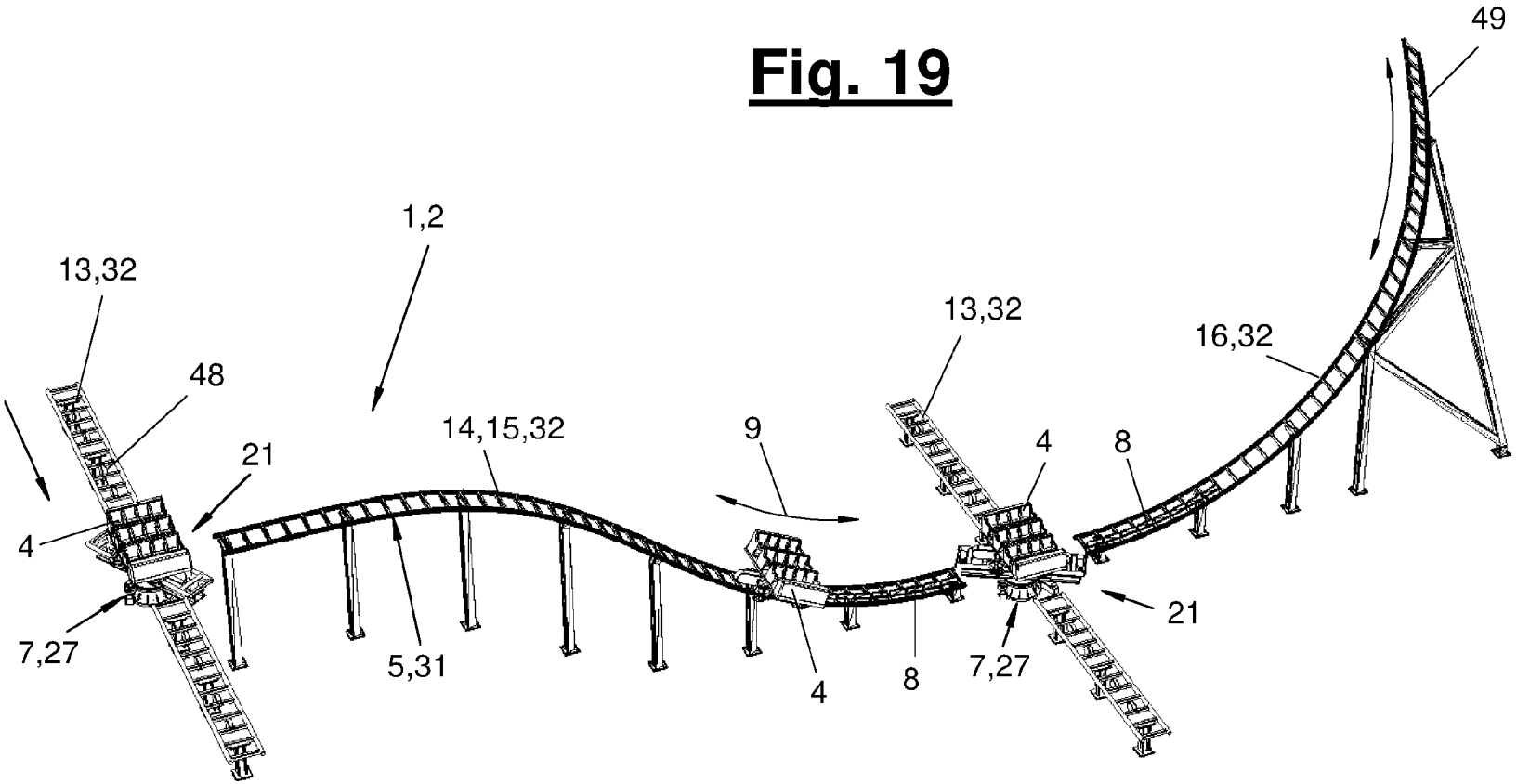
FIG. 19, FIG. 20 and FIG. 21 are different schematic views showing other variants of the transport device with one or more intersections along with deflection units and with a transport path section configured as a dead-end section in different views.
Figure 20:
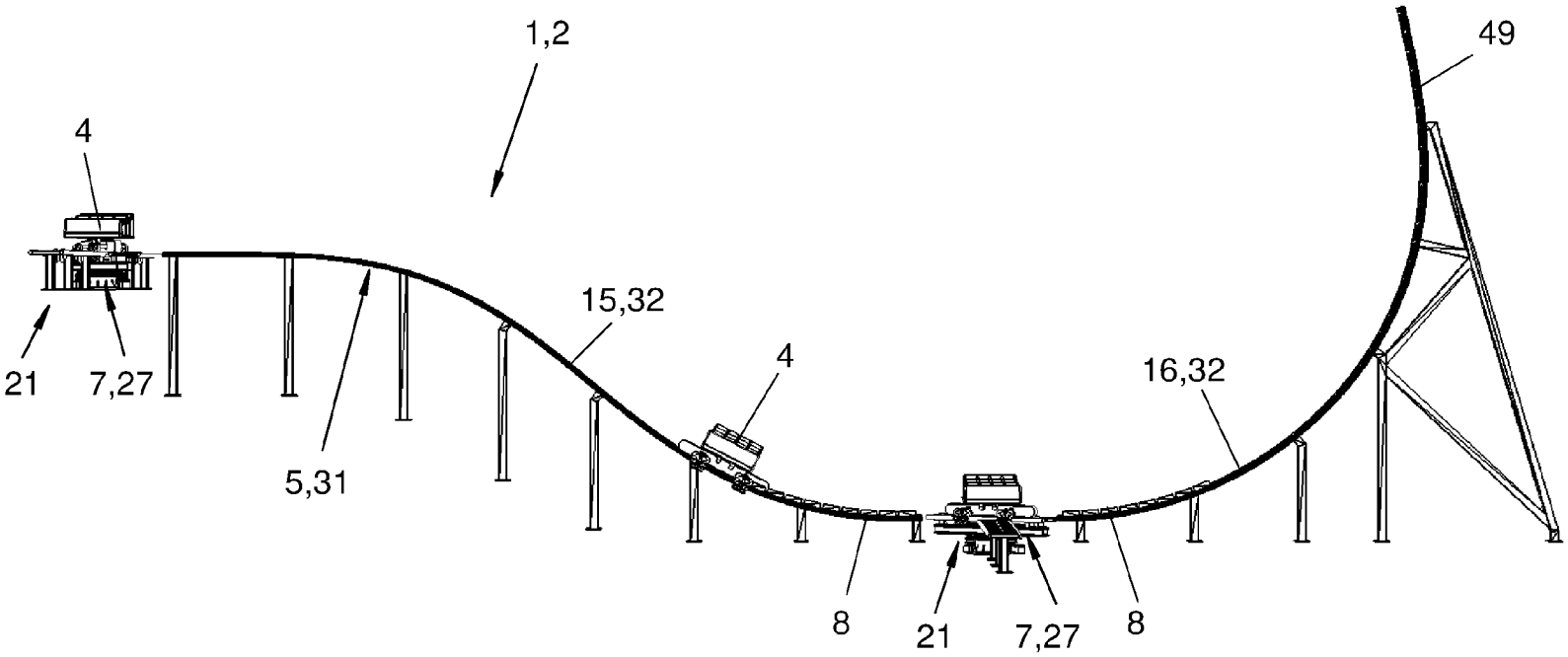
Figure 21:
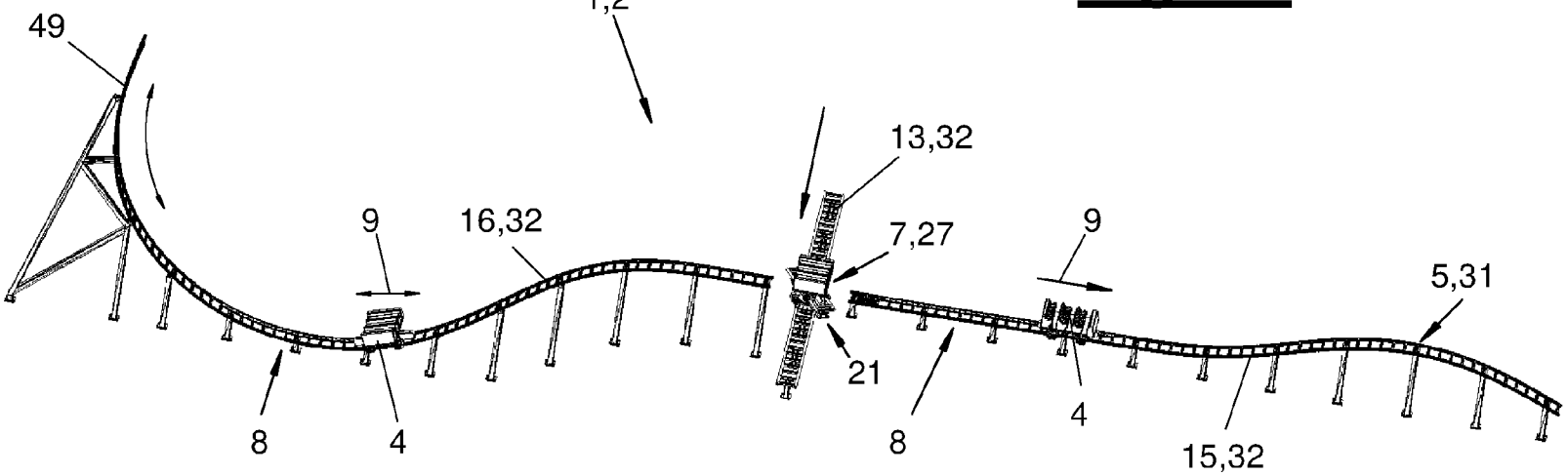

FIGS. 19 through 21 illustrate another variant of the transport device (2), in which a transport section (16), which is configured as a dead-end section or as a cul-de-sac and which has at the end an upright and steep braking ramp (49) for braking and for the reversal of the travel direction of the transport unit (4), may adjoin a change and deflection point, especially an intersection (21). The transport unit (4) may move in opposite directions on this transport path section (16). In addition, a drive device (8) may be arranged here. The transport unit (4) returning from the braking ramp (49) may continue in different directions in an arrangement of an intersection (21) and a correspondingly sloped deflection unit (7), especially a rotating unit (27).

The deflection unit (7) is configured, e.g., as a rotating device (27) of the above-described type. The variation unit (11) preferably has a rotating unit (42).

The exemplary embodiments illustrate, in addition, the possibility that a transport path section (15) adjoins the transport path section (16) at the intersection in an opposing and flush manner, and this flush transport path section (15) has a rising gradient section (6). This gradient section (6) and the braking ramp (49) may form a trough-like track shape, which makes possible a reversing swing travel of the transport unit (4) over the intersection (21). In this case, the passenger orientation (10) can be changed, especially repeatedly, relative to the travel direction (9). A drive device (8) may likewise be arranged at the flush transport path section (15). This drive device (8) may together with the other drive device (8) ensure an acceleration of the transport unit (4) during the swing travel.

FIG. 21 illustrates a variant, in which a trough-shaped track guide is arranged at the transport path section (16) with the braking ramp (49). A swing travel of the transport unit (11) may now take place within the transport path section (16). A respective drive device (8), which is not shown for the sake of clarity, may also be present in this variant at one or more suitable points of the transport path (5).

Different variants of the exemplary embodiments being shown and described are possible. The features of the exemplary embodiments and of the mentioned variants may especially be combined with one another, especially transposed, in a different manner within the framework of the claims.

There are possible variants especially in regard to the guide device (31), which may be configured in a different manner instead of the shown rail guide with a plurality of parallel, e.g., cylinder-tube-like, path elements. This may be, e.g., a rail guide with a central rail. In another variant, an electromagnetic guide in conjunction with an electrical linear motor is possible. In addition, there may be other variants.

While specific embodiments of the invention have been shown and described in detail to illustrate the application of the principles of the invention, it will be understood that the invention may be embodied otherwise without departing from such principles.

LIST OF REFERENCE NUMBERS

1 Amusement facility
2 Transport device for passengers
3 Scenery
4 Transport unit, passenger carrier
5 Transport path
6 Gradient section
7 Deflection unit
8 Drive device
9 Travel direction
10 Passenger orientation
11 Variation unit, change in the passenger orientation
12 Train station
13 Transport path section, parallel
14 Transport path section, cross connection
15 Transport path section, adjoining flush
16 Transport path section, dead-end section
17 Transport path section, slightly curved
18 Transport path section, highly curved
19 Transport path section, movable
20 Path element
21 Intersection
22 Transfer device
23 Transport shuttle
24 Holder
25 Tilting device
26 Tilting unit, sliding path
27 Rotating device
28 Rotating part, single
29 Rotating part, multiple
30 Drive, controllable
31 Guide device, rail arrangement
32 Guide section, rail section
33 Guide element, rail piece, stationary, lengthwise
34 Guide element, rail piece, stationary, crosswise
35 Guide element, rail piece, movable
36 Chassis
37 Passenger holder, seat
38 Drive
39 Platform
40 Guide unit, wheel
41 Drive group, guide unit group, wheel group
42 Rotating unit
43 Pivot bearing
44 Vertical axis
45 Stop unit
46 Drive unit
47 Switch
48 Braking unit
49 Braking ramp

The invention claimed is:

1. An amusement facility comprising:
a transport device for passengers, which has a transport path with a plurality of transport path sections;
a transport unit for passengers, the transport unit being configured to move along the transport path in a travel direction; and
a deflection unit,
wherein the passengers are received with a passenger orientation at the transport unit,
wherein the transport device comprises a drive device for the transport unit,
wherein the transport path comprises a transport path course, which is curved in at least some areas and is twisted in at least some areas, and comprises one or more gradient sections, and at least one abrupt change in the transport path course by about 90° with the deflection unit arranged there,
wherein the at least one deflection unit is configured as a rotating device with a movable transport path section,
wherein the transport device has a variation unit for changing the orientation of the passengers relative to the travel direction of the transport unit, and
wherein the variation unit is controlled for changing the passenger orientation and the rotating device such that the variation unit performs opposite rotations about a vertical axis of the transport unit.

2. An amusement facility in accordance with claim 1, wherein the transport path comprises a guide device with a plurality of guide sections for the transport unit.

3. An amusement facility in accordance with claim 1, further comprising scenery arranged at the transport path for the entertainment of the passengers in connection with the abrupt change in the transport path course.

4. An amusement facility in accordance with claim 1, wherein the transport path comprises a braking unit in front of the abrupt change in the transport path course in the travel direction.

5. An amusement facility in accordance with claim 1, wherein the transport path comprises a gradient section directed downwards in the travel direction subsequent to the abrupt change in the transport path course.

6. An amusement facility in accordance with claim 1, wherein the at least one deflection unit comprises a stop unit and/or a drive unit for the transport unit.

7. An amusement facility in accordance with claim 1, wherein the at least one deflection unit is arranged between at least two transport path sections, which are oriented at right angles to one another.

8. An amusement facility in accordance with claim 7, wherein the transport path has two abrupt changes in the transport path course by about 90° with the deflection unit located there, between which abrupt changes there is arranged a transport path section which is sloped downwards in the travel direction.

9. An amusement facility in accordance with claim 7, wherein the at least one deflection unit is arranged at an intersection of three or more transport path sections.

10. An amusement facility in accordance with claim 9, wherein the variation unit rotates the passenger orientation at the transport unit at the time of the abrupt change or after the abrupt change in the transport path course.

11. An amusement facility in accordance with claim 1, wherein the variation unit is configured to rotate the passenger orientation about the vertical axis of the transport unit in a direction at right angles to the travel direction.

12. An amusement facility in accordance with claim 11, wherein the transport unit comprises a chassis and the vertical axis is arranged centrally at the chassis of the transport unit.

13. An amusement facility in accordance with claim 11, wherein the axis of rotation of the rotating device and the vertical axis of the variation unit coincide.

14. An amusement facility in accordance with claim 1, wherein a transport path section adjoining the at least one deflection unit is configured as a dead-end section or cul-de-sac with an upright braking ramp for braking and for a reversal of the travel direction of the transport unit.

15. An amusement facility in accordance with claim 1, wherein the rotating device comprises a controllable rotary drive and a rotatable transport path section for the transport unit.

16. An amusement facility in accordance with claim 15, wherein the rotating device is arranged between two or more transport path sections that are oriented at right angles to one another and end separately, wherein the rotating device is controllable such that the transport unit arriving at the one transport path section may continue after the rotation to a different transport path section adjoining in the transverse direction, or the transport unit arriving at the one transport path section may continue without rotation to a different transport path section that is flush adjoining.

17. An amusement facility in accordance with claim 15, wherein the rotating device has a single stationary rotating part for receiving the rotatable transport path section.

18. An amusement facility in accordance with claim 1, wherein the transport unit comprises a passenger holder and a chassis with a drive for the meshing with the transport path.

19. An amusement facility in accordance with claim 18, wherein the variation unit is arranged between the passenger holder and the drive for changing the passenger orientation and the variation unit comprises a controllably driven rotating unit for active rotation of the passenger holder relative to the drive in relation to the vertical axis of the transport unit.

20. An amusement facility in accordance with claim 18, wherein the drive has a plurality of drive groups connected separately and independently to the chassis, wherein the variation unit for changing the passenger orientation comprises a respective rotary bearing of the drive groups that is rotatable about the vertical axis of the transport unit wherein the rotary bearings interact with a deflection unit, which is configured as a controllably driven rotating device with a plurality of rotating parts for the respective holder of a single rotatable path element of a rotatable transport path section.

21. An amusement facility in accordance with claim 20, wherein a guide section has stationary guide elements oriented lengthwise and crosswise at a rotatable transport path section and rotatable guide elements, wherein the rotatable guide elements each form a single rotatable path element of the rotatable transport path section.

* * * * *